United States Patent [19]

McDonald et al.

[11] Patent Number: 4,632,191

[45] Date of Patent: Dec. 30, 1986

[54] STEERING SYSTEM FOR PERCUSSION BORING TOOLS

[75] Inventors: William J. McDonald; Gerard T. Pittard; William C. Maurer; John H. Cohen; Gregory C. Givler, all of Houston, Tex.

[73] Assignee: Gas Research Institute, Chicago, Ill.

[21] Appl. No.: 720,582

[22] Filed: Apr. 5, 1985

[51] Int. Cl.[4] ..... E21B 4/06; E21B 7/06; E21B 7/26; E21B 44/00

[52] U.S. Cl. ..... 175/19; 173/91; 175/26; 175/61; 175/73; 175/94

[58] Field of Search ..... 175/19, 26, 61, 62, 175/73–75, 92, 94, 103; 173/91

[56] References Cited

U.S. PATENT DOCUMENTS

| | | | |
|---|---|---|---|
| 3,137,483 | 6/1964 | Zinkiewiez | 175/19 |
| 3,375,885 | 4/1968 | Scott et al. | 175/94 |
| 3,525,405 | 8/1970 | Coyne et al. | 175/94 |
| 3,529,682 | 9/1970 | Coyne et al. | 299/30 |
| 3,630,295 | 12/1971 | Coyne et al. | 175/73 |
| 3,794,128 | 2/1974 | Gagen et al. | 175/73 |
| 3,952,813 | 4/1976 | Chepurnoi et al. | 173/91 |

*Primary Examiner*—James A. Leppink

*Assistant Examiner*—Hoang C. Dang

*Attorney, Agent, or Firm*—Neal J. Mosely

[57] ABSTRACT

A steering system is disclosed for percussion boring tools for boring in the earth at an angle or in a generally horizontal direction. The steering mechanism comprises a slanted-face nose member attached to the anvil of the tool to produce a turning force on the tool and movable tail fins incorporated into the trailing end of the tool which are adapted to be selectively positioned relative to the body of the tool to negate the turning force. The fins are constructed to assume a neutral position relative to the housing of the tool when the tool is allowed to turn and to assume a spin inducing position relative to the housing of the tool to cause it to rotate when the tool is to move in a straight direction. Turning force may also be imparted to the tool by an eccentric hammer which delivers an off-axis impact to the tool anvil. For straight boring, the tail fins are fixed to induce spin of the tool about its longitudinal axis to compensate for the turning effect of the slanted nose member or eccentric hammer. When the fins are in the neutral position, the slanted nose member or the eccentric hammer will deflect the tool in a given direction. The fins also allow the nose piece to be oriented in any given plane for subsequent steering operation.

51 Claims, 43 Drawing Figures

STEERING SYSTEM FOR PERCUSSION BORING TOOLS

BACKGROUND OF THE INVENTION

1. Field of the Invention

This invention relates generally to boring tools, and more particularly to apparatus for steering percussion boring tools.

2. Description of the Prior Art

Utility companies often find it necessary to install or replace piping beneath different types of surfaces such as streets, driveways, railroad tracks, etc. To reduce costs and public inconvenience by eliminating unnecessary excavation and restoration, utilities sometimes use underground boring tools to install the new or replacement pipes. Existing boring tools are suitable for boring short distances (up to 60 ft.), but are not sufficiently advanced to provide directional control for longer distances. This lack of control, coupled with the inability of these tools to detect and steer around obstacles, has limited their use to about 20% of all excavations, with the majority of the remaining excavations being performed by open-cut trenching methods.

Therefore, the development of an economic, guided, horizontal boring tool would be useful to the utility industry, since it would significantly increase the use of boring tools by removing the limitations of poor accuracy and by reducing the occurrence of damage to in-place utilities. Use of such a tool instead of open-cut methods, particularly in developed areas, should result in the savings of millions of dollars annually in repair, landscape restoration and road resurfacing costs.

Conventional pneumatic and hydraulic percussion moles are designed to pierce and compact compressible soils for the installation of underground utilities without the necessity of digging large launching and retrieval pits, open cutting of pavement or reclamation of large areas of land. An internal striker or hammer reciprocates under the action of compressed air or hydraulic fluid to deliver high energy blows to the inner face of the body. These blows propel the tool through the soil to form an earthen casing within the soil that remains open to allow laying of cable or conduit. From early 1970 to 1972, Bell Laboratories, in Chester, N.J., conducted research aimed at developing a method of steering and tracking moles. A 4-inch Schramm Pneumagopher was fitted with two steering fins and three mutually orthogonal coils which were used in conjunction with a surface antenna to track the position of the tool. One of these fins was fixed and inclined from the tool's longitudinal axis while the other fin was rotatable.

Two boring modes could be obtained with this system by changing the position of the rotatable fin relative to the fixed fin. These were (1) a roll mode in which the mole was caused to rotate about its longitudinal centerline as it advanced into the soil and (2) a steering mode in which the mole was directed to bore in a curved path.

The roll mode was used for both straight boring and as a means for selectively positioning the angular orientation of the fins for subsequent changes in the bore path. Rotation of the mole was induced by bringing the rotatable fin into an anti-parallel alignment with the fixed fin. This positioning results in the generation of a force couple which initiates and maintains rotation.

The steering mode was actuated by locating the rotatable fin parallel to the fixed fin. As the mole penetrates the soil, the outer surfaces of the oncoming fins are brought into contact with the soil and a "slipping wedge" mechanism created. This motion caused the mole to veer in the same direction as the fins point when viewed from the back of the tool.

Published information on the actual field performance of the prototype appears limited to a presentation by J. T. Sibilia of Bell Laboratories to the Edison Electric Institute in Cleveland, Ohio on Oct. 13, 1972. Sibilia reported that the system was capable of turning the mole at rates of 1° to 1.5° per foot of travel. However, the prototype was never commercialized.

Several percussion mole steering systems are revealed in the prior art. Coyne et al, U.S. Pat. No. 3,525,405 discloses a steering system which uses a beveled planar anvil that can be continuously rotated or rigidly locked into a given steering orientation through a clutch assembly. Chepurnoi et al, U.S. Pat. No. 3,952,813 discloses an off-axis or eccentric hammer steering system in which the striking position of the hammer is controlled by a transmission and motor assembly. Gagen et al, U.S. Pat. No. 3,794,128 discloses a steering system employing one fixed and one rotatable tail fin.

However, in spite of these and other prior art systems, the practical realization of a technically and cost-effective steering system has been elusive because the prior systems require complex parts and extensive modifications to existing boring tools, or their steering response has been far too slow to avoid obstacles or significantly change the direction of the boring within the borehole lengths typically used.

SUMMARY OF THE INVENTION

It is therefore one object of this invention to provide a cost-effective guided horizontal boring tool which can be used to produce small diameter boreholes into which utilities, e.g., electric or telephone lines, TV cable, gas distribution piping, or the like, can be installed.

It is another object of the present invention to provide a steering system that offers a repeatable and useful steering response in boreholes which is compatible with existing boring equipment and methods and requires only minimal modification of existing boring tools.

Another object of this invention is to provide a steering system which will enable a horizontal boring tool to travel over great distances and reliably hit a small target.

Another object of this invention is to provide boring tool which will produce a guided borehole to avoid obstacles and to correct for deviations from the planned boring path.

Another object of this invention is to provide a boring tool immune to adverse environmental conditions and which allows the boring operation to be conducted by typical field service crews.

A still further object of this invention is to provide a guided horizontal boring tool which requires a minimal amount of excavation for launching and retrieval and thereby reducing the disturbance of trees, shrubs or environmentally sensitive ecosystems.

Other objects of the invention will become apparent from time to time throughout the specification and claims as hereinafter related.

A guided horizontal boring tool constructed in accordance with the present invention will benefit utilities and rate payers by significantly reducing installation and maintenance costs of underground utilities by reducing the use of expensive, open-cut trenching methods.

The above noted objects and other objects of the invention are accomplished by a steering system for percussion boring tools. The steering mechanism comprises a slanted-face nose member attached to the anvil of the tool to produce a turning force on the tool and movable tail fins incorporated into the trailing end of the tool which are adapted to be selectively positioned relative to the body of the tool to negate the turning force. Turning force may also be imparted to the tool by an eccentric hammer which delivers an off-axis impact to the tool anvil. The fins also allow the nosepiece to be oriented in any given plane for subsequent turning or direction change.

BRIEF DESCRIPTION OF THE DRAWINGS

FIGS. 23, 24, 27, 28, 33 and 34 are partial longitudinal cross sections of variations of the fixed/lockable fin assembly using a dowel pin and drive teeth drive, while

DESCRIPTION OF THE PREFERRED EMBODIMENTS

Figure 1:
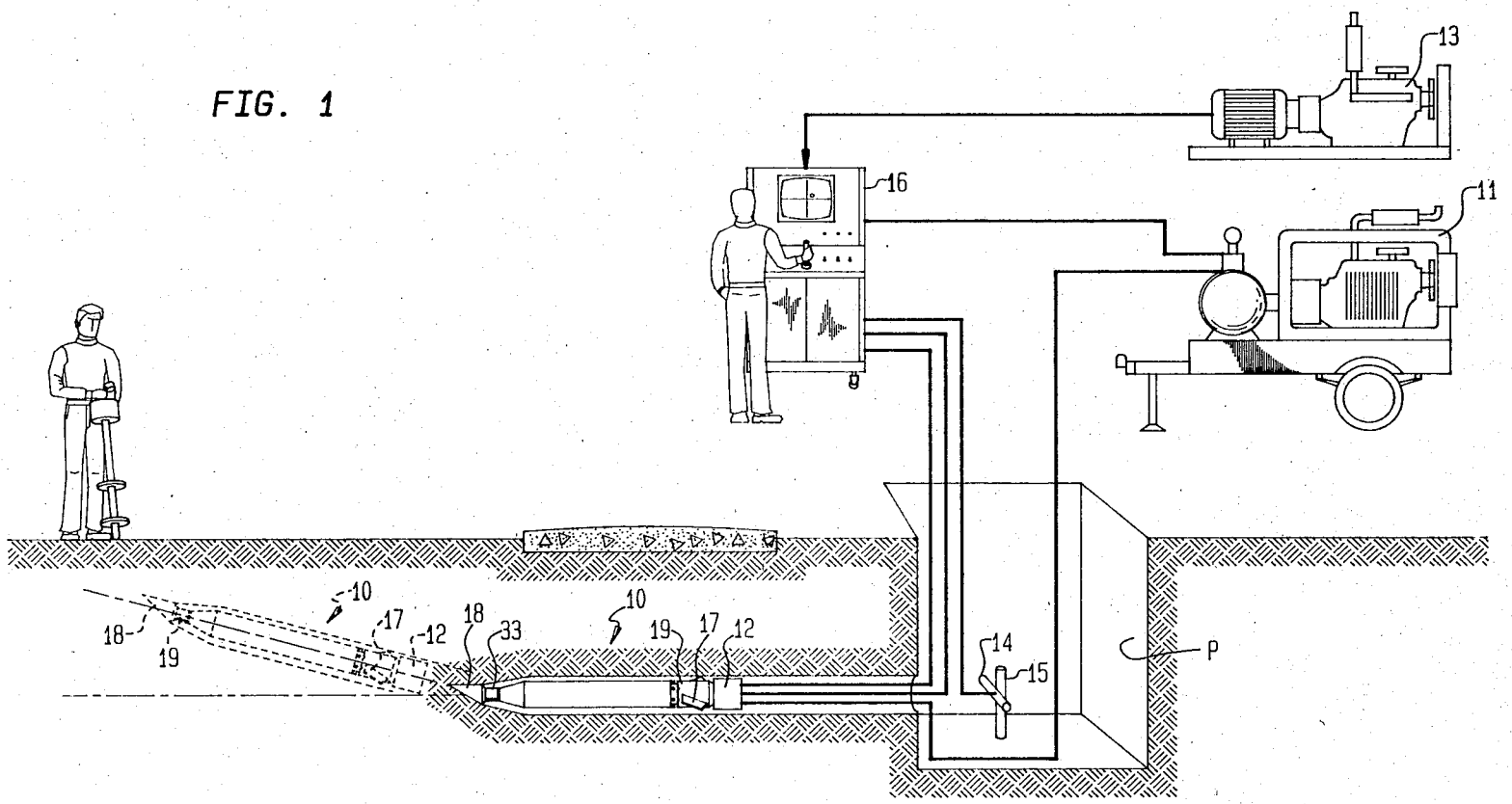
FIG. 1 is a schematic view and partial vertical section through the earth showing a guided horizontal boring tool illustrating the present invention used with a magnetic attitude sensing system.

Referring to the drawings by numerals of reference, and particularly to FIG. 1, there is shown a preferred guided horizontal boring tool 10 used with a magnetic field attitude sensing system. The boring tool 10 may be used with various sensing systems, and a magnetic attitude sensing system is depicted generally as one example. The usual procedure for using percussion moles is to first locate and prepare the launching and retrieval pits. The launching pit P should be dug slightly deeper than the planned boring depth and large enough to provide sufficient movement for the operator. The mole or boring tool 10 is connected to a pneumatic or hydraulic source 11, is then started in the soil, stopped and properly aligned, preferably with a sighting frame and level. The tool is then restarted and boring continued until the tool exits into the retrieval pit (not shown).

The boring tool 10 may have a pair of coils 12 at the back end, one of which produces a magnetic field parallel to the axis of the tool, and the other produces a magnetic field transverse to the axis of the tool. These coils are intermittently excited by a low frequency generator 13. To sense the attitude of the tool, two coils 14 and 15 are positioned to the pit P, the axes of which are perpendicular to the desired path of the tool. The line perpendicular to the axes of these coils at the coil intersection determines the boresite axis.

Outputs of these coils can be processed to develop the angle of the tool in both the horizontal and vertical directions with respect to the boresite axis. Using the transverse field, the same set of coils can be utilized to determine the angular rotation of the tool to provide sufficient control for certain types of steering systems. For these systems, the angular rotation of the tool is displayed along with the plane in which the tool is expected to steer upon actuation of the guidance control system.

The mechanical guidance of the tool can also be controlled at a display panel 16. From controls located at display panel 16, both the operation of the tool 10 and the pneumatic or hydraulic actuation of the fins 17 can be accomplished as described hereinafter.

As shown in FIG. 1, the boring tool 10 includes a steering system comprising a slanted-face nose member 18 attached to the anvil 33 of the tool to produce a turning force on the tool and tail fins 17 on a rotary housing 19 on the trailing end of the tool which are adapted to be selectively positioned relative to the body of the tool to negate the turning force. Turning force may also be imparted to the tool by an internal eccentric hammer (FIG. 41) described hereinafter which delivers an off-axis impact to the tool anvil.

For turning the tool, the tail fins 17 are moved into a position where they may spin about the longitudinal axis of the tool 10 and the slanted nose member 18 or eccentric hammer will deflect the tool in a given direction. When the fins 17 are moved to a position causing the tool 10 to rotate about its longitudinal axis, the rotation will negate the turning effect of the nose member 18 or eccentric hammer as well as provide a means for orienting the nose piece or hammer into any given plane for subsequent turning or direction change. It should be understood that either an eccentric hammer or anvil will produce the desired turning force, since the only requirement is that the axis of the impact does not pass through the frontal center of pressure.

The steering system of the present invention will allow the operator to avoid damaging other underground services (such as power cables) or to avoid placing underground utilities where they may be damaged.

FIGS. 2 through 7 illustrate various combinations and implementations of the combination slanted nose member and tail fins steering system schematically and illustrates the basic operation of each design. The function of the tail fins is to provide a method of executing controlled changes to the boring direction.

Figure 2:
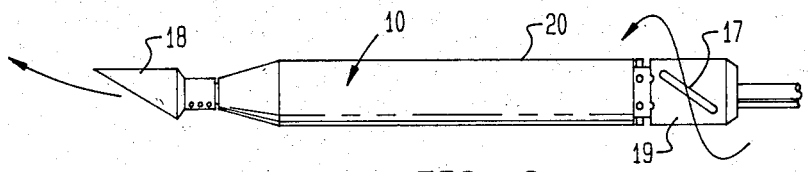
FIGS. 2 and 3 are schematic views, in elevation, of a fixed/lockable tail fin steering system.
Figure 3:
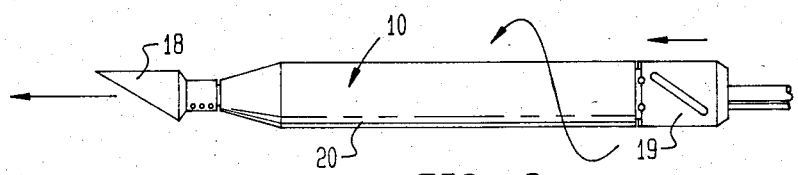

A fixed/lockable tail fin steering system 17 is illustated in FIGS. 2 and 3. To turn the tool 10, the tool is allowed to rotate about the longitudinal axis due to the turning force of the tail fins when in the locked position until the proper tool face orientation is obtained (FIG. 2). The housing 19 is then unlocked and spins freely, whereby the tool moves in a curved path by the turning force of the slanted face nose member 18. Straight boring by the tool 10 is accomplished by locking the tail fin housing 19 to the main body 20 of the tool 10 (FIG. 3), to rotate the tool body and thus negate the turning action of the slanted nose member 18.

A boring tool 21 having a movable tail fin system is illustrated in FIGS. 4–7. To turn or change direction of the tool 21, the tail fins 22 are activated to a parallel position relative to the longitudinal axis of the tool body 20 and the tool 21 is allowed to turn relative to the longitudinal axis due to the turning force of the nose member 18 or the eccentric hammer. Proper tool face orientation is obtained (FIGS. 4 and 5) by use of the tail fins in a skewed inclined position. Straight boring of the tool is accomplished by activating the fins 22 to an inclined position relative to the mole axis (FIGS. 6 and 7) to rotate the tool body and thus negate the turning action of the slanted nose member 18.

Figure 8:
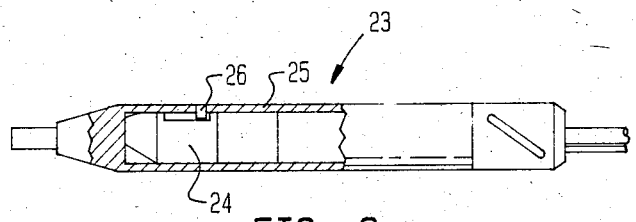
FIG. 8 is a schematic view, in elevation, of a movable fin system in combination with an eccentric hammer.
Figure 4:
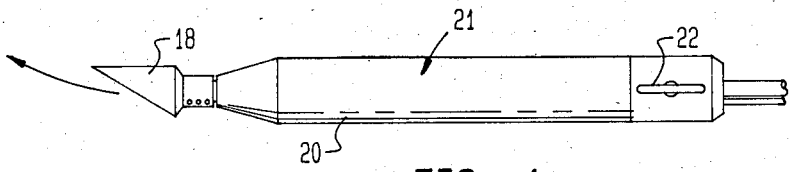
FIGS. 4 through 7 are schematic views, in elevation, of a movable tail fin system.
Figure 5:
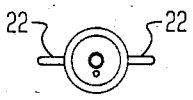
Figure 6:
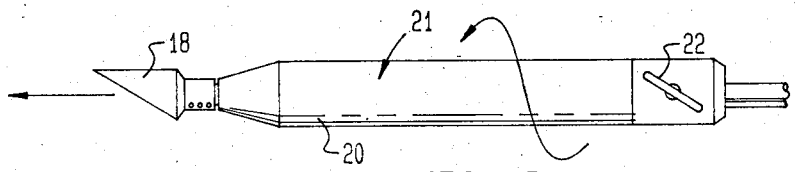
Figure 7:
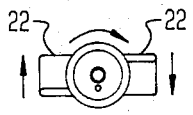

FIG. 8 illustrates a boring tool 23 with a movable tail fin system in combination with an eccentric hammer 24. It should be understood that the eccentric hammer may be used in combination with either the fixed/lockable fin system or the movable fin system and with or without the slanted nose member, depending upon the particular application. Either an eccentric hammer or anvil will produce the desired result, since the only requirement is that the axis of the impact does not pass through the frontal center of pressure. Unless negated by one of the previously described fin systems, the eccentric hammer 24 provides the side force required to turn the tool.

The eccentric hammer 24 is keyed to the main body 25 of the tool 23 by a pin 26 or other suitable means to maintain the larger mass of the hammer on one side of the longitudinal axis of the tool. Turning of the tool 23 is accomplished by unlocking the tail fin housing of the fixed/lockable embodiment from the main mole body or turning the fins of the movable fin embodiment to a position parallel to the body axis. The parallel fins or unlocked housing position eliminates the fins ability to negate the eccentric hammer force. To steer the tool 23, the tail fin housing is unlocked or the fins are activated to a skewed inclined position relative to the tool body axis and the tool is turned by the eccentric hammer force until the proper tool face orientation is obtained.

Straight boring is accomplished in all of the previously described implementations by continuously rotating the tool. This distributes the turning force over 360° and causes the tool to bore a helical (nearly straight) hole.

FIGS. 9A, 9B, 9C, and 10 illustrate a typical boring tool 27 having a slanted nose member and fixed/lockable fin arrangement as described generally in reference to FIGS. 1 and 2. As shown, the boring tool 10 comprises an elongated hollow cylindrical outer housing or body 28. The outer front end of the body 28 tapers inwardly forming a conical portion 29. The internal diameter of the body 28 tapers inwardly near the front end forming a conical surface 30 which terminates in a reduced diameter 31 extending longitudinally inward from the front end. The rear end of the body 28 has internal threads 32 for receiving a tail fin assembly (see FIG. 9C).

An anvil 33 having a conical back portion 34 and an elongated cylindrical front portion 35 is positioned in the front end of body 28. The conical back portion 34 of anvil 33 forms an interference fit on the conical surface 30 of the body 28, and the elongated cylindrical portion 35 extends outwardly a predetermined distance beyond the front end of the body. A flat transverse surface 36 at the back end of the anvil 33 receives the impact of a reciprocating hammer 37.

Reciprocating hammer 37 is an elongated cylindrical member slidably received within the cylindrical recess 38 of the body 28. A substantial portion of the outer diameter of the hammer 37 is smaller in diameter than the recess 38 of the body 28, forming an annular cavity 39 therebetween. A relatively shorter portion 40 at the back end of the hammer 37 is of larger diameter to provide a sliding fit against the interior wall of recess 38 of the body 28.

A central cavity 41 extends longitudinally inward a distance from the back end of the hammer 37. A cylindrical bushing 42 is slidably disposed within the hammer cavity 41, the circumference of which provides a sliding fit against the inner surface of the central cavity 41. The front surface 43 of the front end of the hammer 37 is shaped to provide an impact centrally on the flat surface 36 of the anvil 33. As described hereinafter, the hammer configuration may also be adapted to deliver an eccentric impact force on the anvil.

Air passages 44 in the sidewall of hammer 37 inwardly adjacent the shorter rear portion 40 communicate the central cavity 41 with the annular cavity 39. An air distribution tube 45 extends centrally through the bushing 42 and has a back end 46 extending outwardly of the body 28 connected by fittings 47 to a flexible hose 48. For reciprocating the hammer 37, the air distribution tube 45 is in permanent communication with a compressed air source 11 (FIG. 1). The arrangement of the passages 44 and the bushing 42 is such that, during reciprocation of the hammer 37, the air distribution tube 45 alternately communicates via the passages 44, the annular cavity 39 with either the central cavity 41 or atmosphere at regular intervals.

A cylindrical stop member 49 is secured within the recess 38 in the body 28 near the back end and has a series of longitudinally-extending, circumferentially-spaced passageways 50 for exhausting the interior of the body 28 to atmosphere and a central passage through which the air distribution tube 45 extends.

Figure 9A:
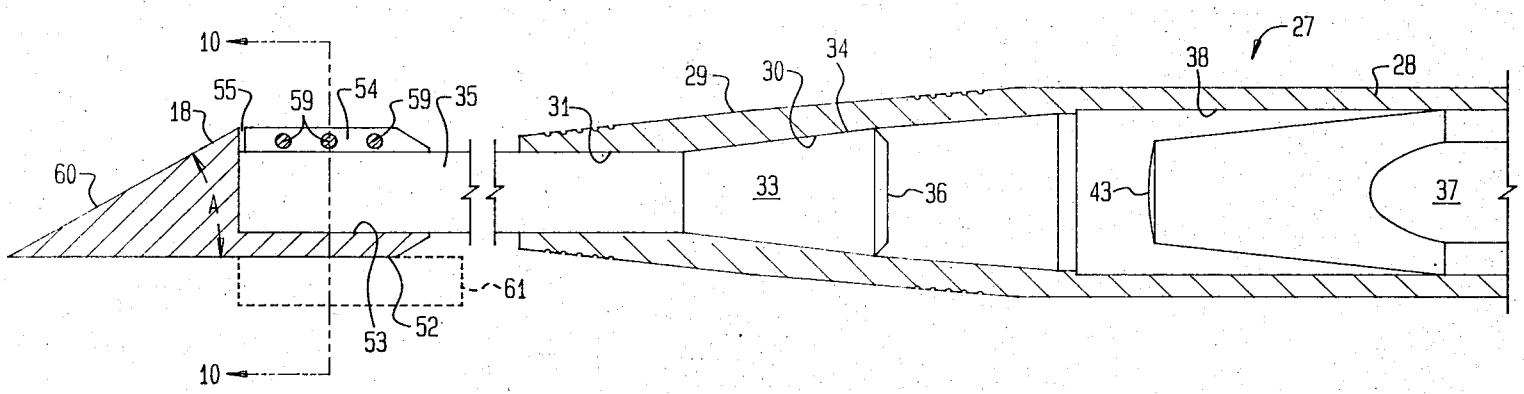
FIGS. 9A, 9B, and 9C are segments in longitudinal cross section of a typical boring tool having a slanted nose member and fixed/lockable fin arrangement in the unlocked position.
Figure 10:
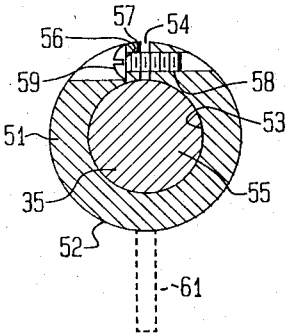
FIG. 10 is a vertical cross sectional view of the slanted nose member taken along the line 10—10 of FIG. 9A.

A slant-end nose member 18 has a cylindrically recessed portion 52 with a central cylindrical bore 53 therein which is received on the cylindrical portion 35 of the anvil 33 (FIGS. 9A and 10). A slot 54 through the sidewall of the cylindrical portion 18 extends longitudinally substantially the length of the central bore 53 and a transverse slot extends radially from the bore 53 to the outer circumference of the cylindrical portion, providing flexibility to the cylindrical portion for clamping the nose member to the anvil. A flat 56 is provided on one side of cylindrical portion 18 and longitudinally spaced holes 57 are drilled therethrough in alignment with threaded bores 58 on the other side. Screws 59 are received in the holes 57 and bores 58 and tightened to secure the nose member 18 to the anvil 33.

The sidewall of the nose member 18 extends forward from the cylindrical portion 52 and one side is milled to form a flat inclined surface 60 which tapers to a point at the extended end. The length and degree of inclination may vary depending upon the particular application. The nose member 18 may optionally have a flat rectangular fin 61 (shown in dotted line) secured to the sidewall of the cylindrical portion 52 to extend substantially the length thereof and radially outward therefrom in a radially opposed position to the inclined surface 60.

Slanted nose members 18 and 2½" and 3½" diameter with angles from 10° to 40° (as indicated an angle "A") have been tested and show the nose member to be highly effective in turning the tool with a minimum turning radius of 28 feet being achieved with a 3½ inch 15 degree nose member. Testing also demonstrated that the turning effect of the nose member was highly repeatable with deviations among tests of any nose member seldom varying by more than a few inches in 35 feet of bore. Additionally, the slanted nose members were shown to have no adverse effect on penetration rate and in some cases, actually increased it.

It has also been found that the turning radius varies linearly with the angle of inclination. For a given nose angle, the turning radius will decrease in direct proportion to an increase in area.

Figure 9B:
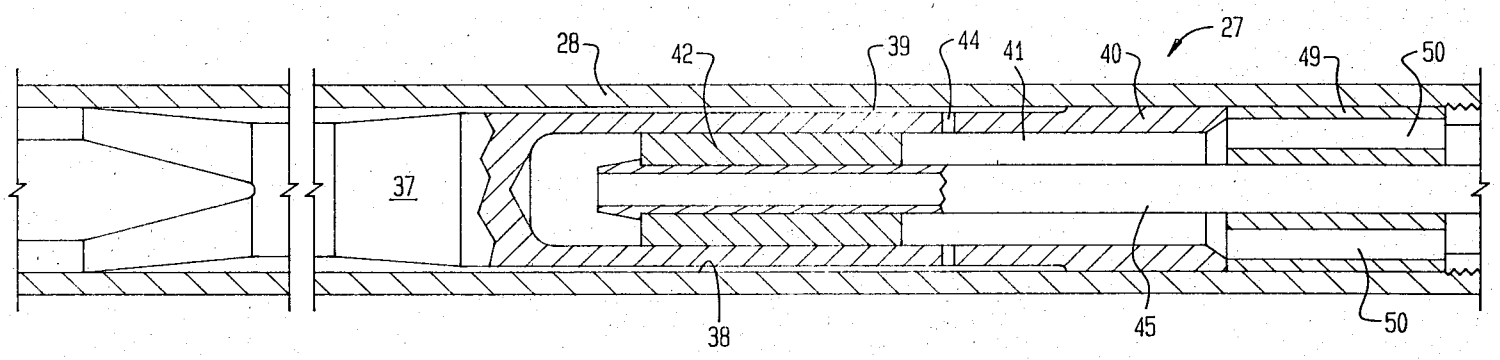
Figure 9C:
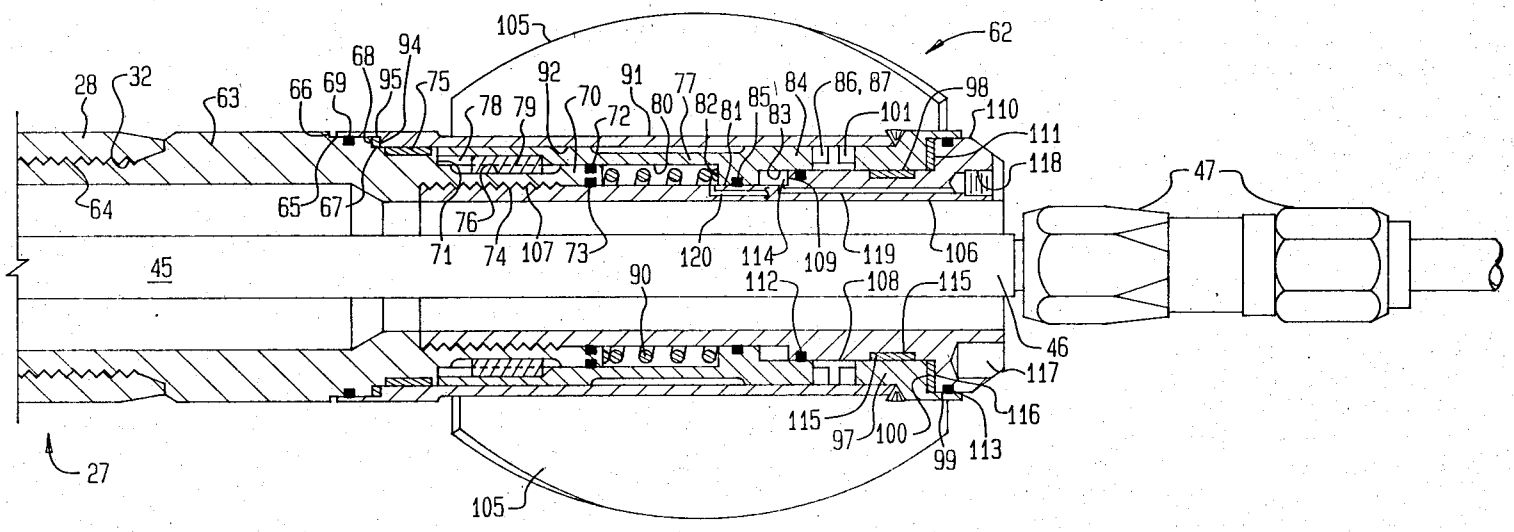

A tail fin assembly 19 is secured in the back end of the body 28 (FIG. 9C). A fixed/lockable tail fin assembly 19 is illustrated in the example and other variations will be described hereinafter. The tail fin assembly 19 comprises a cylindrical connecting sub 63 having external threads 64 at the front end which are received within the internal threads 32 at the back end of the body 28. Sub 63 has a short reduced outside diameter portion 65 forming a shoulder 66 therebetween and a second reduced diameter 67 adjacent the short portion 65 forms a second shoulder 68. An O-ring seal 69 is located on the reduced diameter 65 intermediate the shoulders 66 and 68. The rear portion 70 of the sub 63 is smaller in diameter than the second reduced diameter 67 forming a third shoulder 71 therebetween and provided with a circumferential O-ring seal 72 and in internal O-ring seal 73. Internal threads 74 are provided in the rear portion 70 inwardly of the seal 73. A circumferential bushing 75 of suitable bearing material such as bronze is provided on the second reduced diameter 67.

A series of longitudinal circumferentially spaced grooves or keyways 76 are formed on the circumference of the rear portion 70 of the sub 63. A hollow cylindrical piston 77 is slidably received on the circumference of the rear portion 70. A series of longitudinal circumferentially spaced grooves or keyways 78 are formed on the interior surface at the front portion of the piston 77 in opposed relation to the sub keyways 76. A series of keys or dowel pins 79 are received within the keyways 76 and 78 to prevent rotary motion between the sub 63 and the piston 77.

Figure 13:
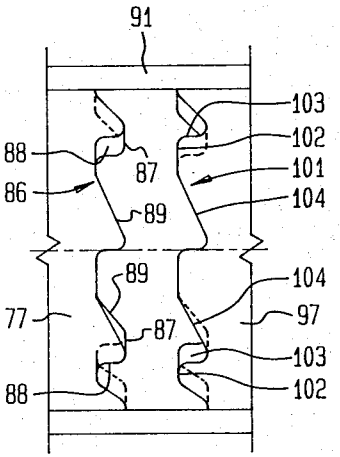
FIG. 13 is a partial elevation of the drive teeth assembly of the fixed/lockable tail fin assembly.

A first internal cavity 80 extends inwardly from the keyway 78 terminating in a short reduced diameter portion 81 which forms a shoulder 82 therebetween. A second cavity 83 extends inwardly from the back end 84 of the piston 77 terminating at the reduced diameter portion 81. An internal annular O-ring seal 85 is provided on the reduced diameter portion 81. As shown in FIGS. 9C and 13, a series of drive teeth 86 are formed on the back end of the piston 77. The teeth 86 comprise a series of circumferentially spaced raised surfaces 87 having a straight side 88 and an angularly sloping side 89 forming a one-way ratchet configuration. A compression spring 90 is received within the first cavity 80 of the piston 77 and is compressed between the back end 70 of the sub 63 and the shoulder 82 of the piston 77 to urge the piston outwardly from the sub.

An elongated, hollow cylindrical rotating fin sleeve 91 is slidably and rotatably received on the outer periphery of the sub 63. The fin sleeve 91 has a central longitudinal bore 92 and a short counterbore 93 of larger diameter extending inwardly from the front end and defining an annular shoulder 94 therebetween. The counterbore 93 fits over the short reduced diameter 65 of the sub 63 with the O-ring 69 providing a rotary seal therebetween. A flat annular bushing 95 of suitable bearing material such as bronze is disposed between the shoulders 68 and 94 to reduce friction therebetween. A second counterbore 96 extends inwardly from the back end of the fin sleeve 91.

A hollow cylindrical sleeve 97 is secured within the second counterbore 96 by suitable means such as welding. The sleeve 97 has a central bore 98 substantially the same diameter as the second cavity 83 of the piston 77 and a counterbore 99 extending inwardly from the back end defining a shoulder 100 therebetween. As shown in FIGS. 9C and 13, a series of drive teeth 101 are formed on the front end of the sleeve 97. The teeth 101 comprise a series of circumferentially spaced raised surfaces 102 having a straight side 103 and an angularly sloping side 104 forming a one-way ratchet configuration. The teeth correspond in opposed relationship to the teeth 86 of the piston 77 for operative engagement therewith.

Figure 12:
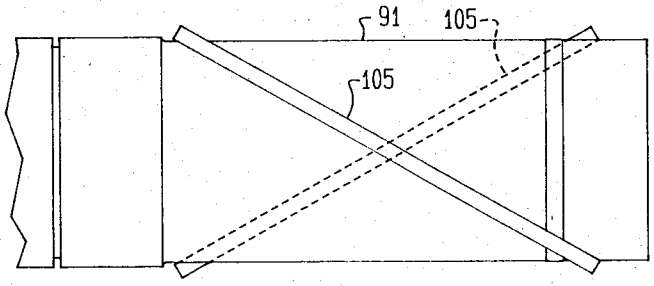
FIG. 12 is a view, in side elevation, of the fixed/lockable tail fin assembly of FIG. 9C in the locked position.

A series of flat radially and angularly opposed fins 105 are secured to the exterior of the fin sleeve 91 to extend radially outward therefrom. (FIGS. 9C, 11 and 12) The fins 105 are secured at opposing angles relative to the longitudinal axis of the sleeve 91 to impart a rotational force on the sleeve.

An elongated hollow cap sleeve 106 having external threads 107 at the front end is slidably received within the sliding piston 77 and the sleeve 97 and threadedly secured in the internal threads 74 at the rear portion 70 of the sub 63. The cap sleeve 106 extends rearwardly from the threads 107 and an enlarged diameter portion 108 forms a first shoulder 109 spaced from the threaded portion and a second enlarged diameter 110 forms a second shoulder 111 spaced from the first shoulder. An O-ring seal 112 is provided on the enlarged diameter 108 near the shoulder 109 and a second O-ring seal 113 is provided on the second enlarged diameter 110 near the second shoulder 111. The O-ring 112 forms a reciprocating seal on the interior of the second cavity 83 of the piston 77 and the O-ring 113 forms a rotary seal on the counterbore 99 of the sleeve 97. The O-ring 85 in the piston 77 forms a reciprocating seal on the extending sidewall of the cap 106.

An annular chamber 114 is formed between the exterior of the sidewall of the cap 106 and the second counterbore 83 which is sealed at each end by the O-rings 85 and 112. A circumferential bushing 115 is provided on the first enlarged diameter 108 and an annular bushing 116 on the second enlarged diameter 110 is captured between the shoulders 100 and 111 to reduce friction between the sleeve 97 and the cap 106. The rear portion of the cap 106 has small bores 117 arranged to receive a spanner wrench for effecting the threaded connection. A threaded bore 118 at the back end of the cap 106 receives a hose fitting (not shown) and a small passageway 119 extends inwardly from the threaded bore 118 to communicate the annular chamber 114 with a fluid or air source (not shown). A flexible hose extends outwardly of the cap 106 and is connected to the fluid or air source for effecting reciprocation of the piston 77. A second small passageway 120 communicates the first cavity 80 with atmosphere to relieve pressure which might otherwise become trapped therein. Passage 120 may also be used for application of pressure to the forward end of the piston 77 for return movement.

OPERATION

Having thus described the major components of the boring tool assembly, an explanation of the operation of a typical boring tool and the tail fin assembly follows.

Figure 14:
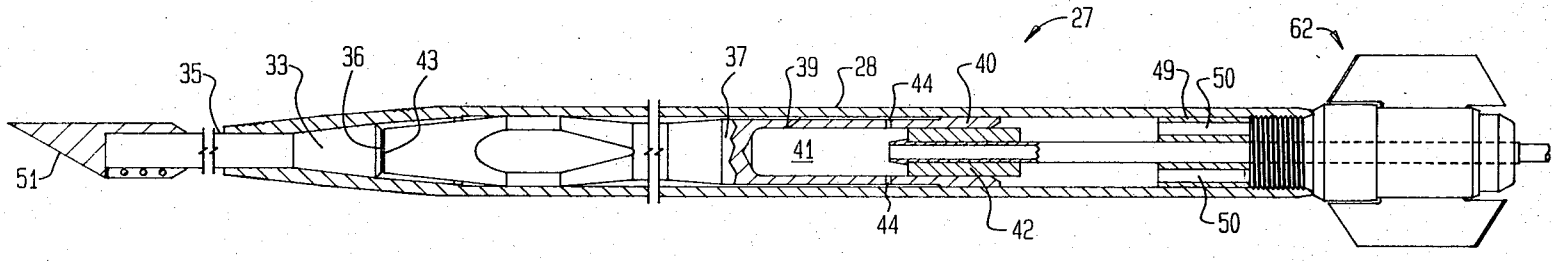
FIGS. 14 and 15 are schematic views in longitudinal cross section showning the operation of a typical percussion boring tool according to this invention.
Figure 15:
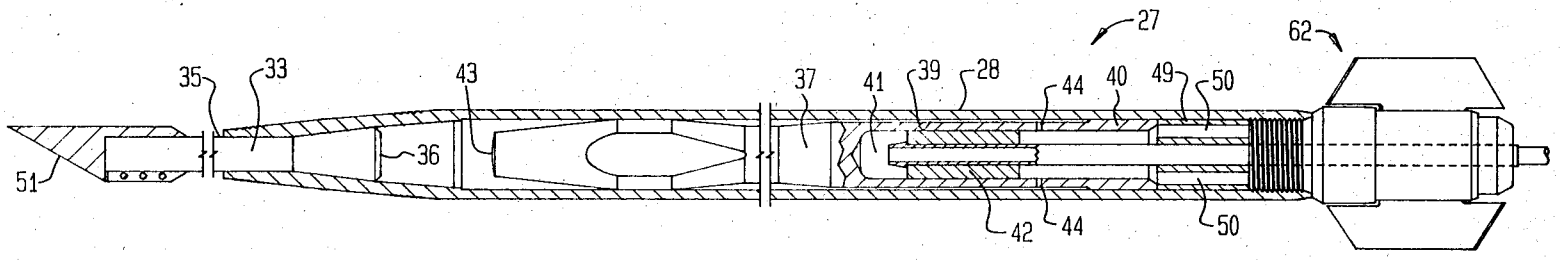

The operation of the percussion boring tool 27 is illustrated schematically in FIGS. 14 and 15. Under action of compressed air or hydraulic fluid in the central cavity 41, the hammer 37 moves toward the front of the body 28. At the foremost position, the hammer imparts an impact on the flat surface 36 of the anvil 33.

In this position (FIG. 14), compressed air is admitted through the passages 44 from the central cavity 41 into the annular cavity 39. Since the effective area of the hammer including the larger diameter rear portion 40 is greater than the effective area of the central cavity 41, the hammer starts moving in the opposite direction. During this movement, the bushing 42 closes the passages 44 (FIG. 15), thereby interrupting the admission of compressed air into annular cavity 41.

The hammer 37 continues its movement by the expansion of the the air in the annular cavity 39 until the passages 44 are displaced beyond the ends of the bushing 42, and the annular cavity exhausts to atmosphere through the holes 50 in the stop member 49. In this position, the air is exhausted from the annular cavity 39 through the passages 44 now above the trailing edge of the bushing 42 and the holes 50 in the stop member 49. Then the cycle is repeated.

Figure 11:
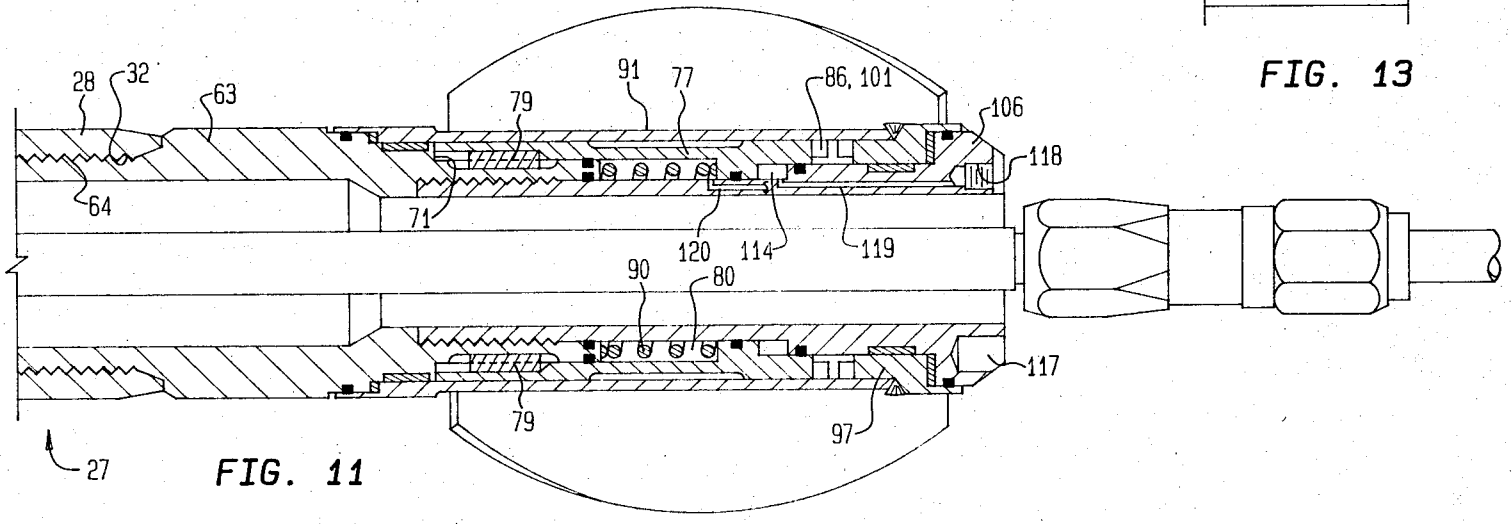
FIG. 11 is a longitudinal cross section of the fixed/-lockable tail fin assembly of FIG. 9C in the locked position.

The operation of the tail fin assembly 62 is best seen with reference to FIGS. 9C and 11. The compressed air or fluid in the annular cavity 114 moves the piston 77 against the force of the spring 90 and toward the front of the sub 63. In the foremost position, the front end of the piston 77 contacts the shoulder 71 and the drive teeth 86 and 101 becomes dis-engaged. In this position (FIG. 9C), compressed air or fluid is admitted through the passage 119 from the source into the annular chamber 114. The fin sleeve 91 is then free to rotate relative to the tool body.

When the air or fluid pressure within the chamber 114 is relieved, the force of the spring 90 moves the piston 77 in the opposite direction (FIG. 11). During this movement, the drive teeth 86 and 101 becomes engaged once again and the fin sleeve 91 becomes locked against rotational movement relative to the tool body. Pressure which may otherwise become trapped in the first cavity 80 and hinder reciprocation is exhausted through the pressure relief passage 120 to atmosphere. The cycle may be selectively repeated as necessary for proper alignment the slanted nose member 18 and attitude adjustment of the tool. It should be understood that the passage 120 may also be connected to a fluid, i.e. liquid or air, source for moving the piston to the rearward position.

ANOTHER EMBODIMENT

Figure 16:
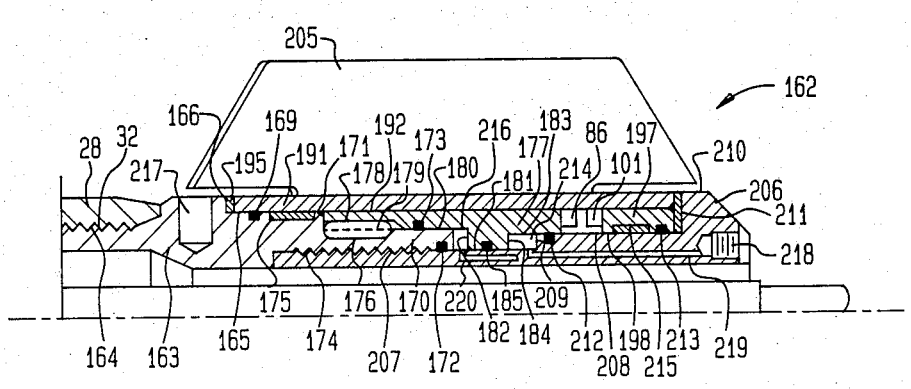
FIGS. 16 through 19 are partial longitudinal cross sections of a variations of the fixed/lockable fin assembly in the locked or unlocked positions.
Figure 17:
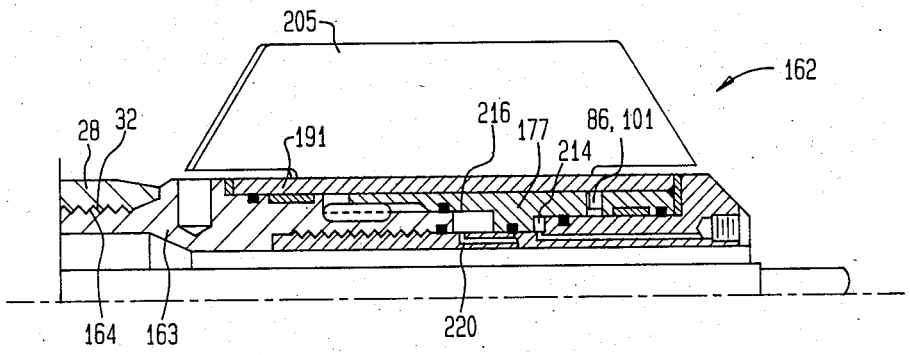

Another embodiment of the tail fin assembly clutch mechanism is illustrated in FIGS. 16 and 17. Some parts are given the same numerals of reference to avoid repetition. The tail fin assembly 119 comprises a cylindrical connecting sub 163 having external threads 164 at the front end which are received within the internal threads 32 at the back end of the body 28. Sub 163 has a short reduced outside diameter portion 165 forming a shoulder 166. The rear portion 170 of the sub 163 is smaller in diameter than the reduced diameter 165 forming a third shoulder 171 therebetween and provided with a circumferential O-ring seal 172.

A series of longitudinal circumferentially-spaced grooves or keyways 176 are formed on the rear portion 170 of the sub 163. A hollow cylindrical piston 177 is slidably received on the circumference of the rear portion 170. A series of longitudinal circumferentially spaced grooves or keyways 178 are formed on the interior surface at the front portion of the piston 177 in opposed relation to the sub keyways 176. A series of keys or dowel pins 179 are received within the keyways 176 and 178 to prevent rotary motion between the sub 163 and the piston 177.

A first internal cavity 180 extends inwardly from the keyway 178 terminating in a short reduced diameter portion 181 which forms a shoulder 182 therebetween. A second cavity 183 smaller than the first extends inwardly from the back end 184 of the piston 77 terminating at the reduced diameter portion 181. O-ring seals 173 and 185 are provided on the interior of the first cavity 180 and reduced diameter portion 181 respectively. As previously shown and described with reference to FIG. 13, a series of drive teeth 86 are formed on the back end of the piston 177. The teeth 86 comprise a series of circumferentially spaced raised surfaces 87 having a straight side 88 and an angularly sloping side 89 forming a one-way ratchet configuration.

An elongated hollow cylindrical rotating fin sleeve 191 is rotatably received on the outer periphery of the sub 163. The fin sleeve 191 has a central longitudinal bore 192. The bore 192 is rotatably received on the reduced diameter 165 of the sub 163 with the O-ring 169 providing a rotary seal therebetween. A flat annular bushing 195 of suitable material such as bronze is disposed between the shoulder 168 and the front of the fin sleeve 191 to reduce friction.

A hollow cylindrical sleeve 197 is secured within the rear portion of the fin sleeve bore 192 by suitable means such as welding. The sleeve 197 has a central bore 198 substantially the same diameter as the second cavity 183 of the piston 177. As previously shown and described with reference to FIG. 13, a series of drive teeth 101 are formed on the front end of the sleeve 197. The teeth 101 comprise a series of circumferentially spaced raised surfaces 102 having a straight side 103 and an angularly sloping side 104 forming a one-way ratchet configuration. The teeth correspond in opposed relationship to the teeth 86 of the piston 177 for operative engagement therewith. An O-ring 213 and a bushing 215 are provided in the central bore 198.

A series of flat, radially and angularly opposed fins 205 are secured to the exterior of the fin sleeve 191 to extend radially outward therefrom. The fins 205 are secured at opposing angles relative to the longitudinal axis of the sleeve 191 to impart a rotational force on the sleeve.

An elongated hollow cylindrical cylinder cap 206 having external threads 207 at the front end is slidably received within the sliding piston 177 and the sleeve 197 and threadedly secured in the internal threads 174 at the rear portion 170 of the sub 163. The circumference of the cap 206 extends rearwardly from the threads 207 and an enlarged diameter portion 208 forms a first shoulder 209 spaced from the threaded portion and a second enlarged diameter 210 forms a second shoulder 211 spaced from the first shoulder. An O-ring seal 212 is provided on the enlarged diameter 208 near the shoulder 209. The O-ring 212 forms a reciprocating seal on the interior of the second cavity 183 of the piston 177 and the O-ring 213 forms a rotary seal on the central bore 198 of the sleeve 197. The O-ring 185 in the piston 177 forms a reciprocating seal on the extended sidewall of the cap 206.

An annular rear chamber 214 is formed between the exterior of the sidewall of the cap 206 and the second smaller bore 183 which is sealed at each end by the O-rings 185 and 212. An annular front chamber 216 is formed between the sidewall of the cap 206, the cavity 180, and the back end of the sub 163, which is sealed by the O-rings 172, 173, and 185. The side wall of the sub 163 has small bores 217 arranged to receive a suitable wrench for effecting the threaded connection. A threaded bore 218 at the back end of the cap 206 receives a hose fitting (not shown) and a small passageway 219 extends inwardly from the threaded bore 218 to communicate the rear chamber 214 with a fluid or air source (not shown). Another similar threaded bore at the back end of the cap receives a hose fitting (not shown) and a small passageway 220 extends inwardly from the threaded bore to communicate the front chamber 216 with a fluid or air source (not shown). Flexible hoses extend outwardly of the cap 206 and are connected to the fluid or air source for effecting reciprocation of the piston 177.

The operation of the tail fin assembly 119 is illustrated schematically in FIGS. 16 and 17. Under action of compressed air or fluid in the rear chamber 214, the piston 177 moves toward the front of the sub 163. When in its foremost position, the drive teeth 86 and 101 are disengaged and the fin sleeve 191 is free to rotate about the longitudinal axis of the tool body. In this position (FIG. 16), compressed air or fluid in the front chamber 216 has been exhausted. To lock the tail fins against rotational movement, compressed air or fluid is admitted through the passage 220 into the front chamber 216 and exhausted from the rear chamber 214 to move the piston 177 in the opposite direction. In this position (FIG. 17), the drive teeth 86 and 101 are once again engaged preventing rotational movement. The cycle may be selectively repeated as necessary for proper alignment the slanted nose member and attitude adjustment of the tool.

A FURTHER EMBODIMENT

Figure 18:
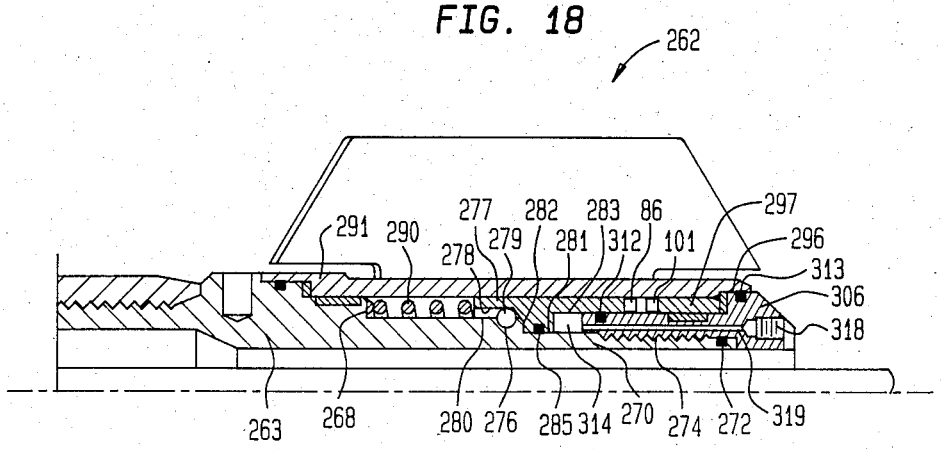
Figure 19:
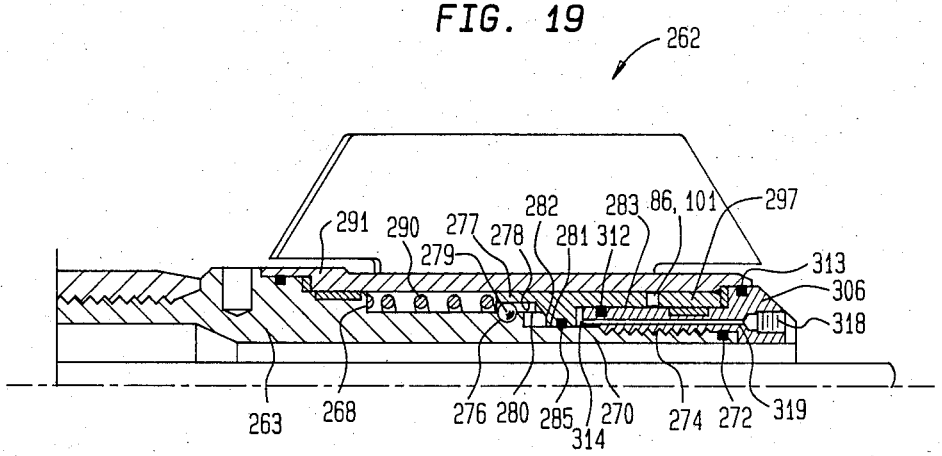

Another variation of the fixed/lockable tail fin assembly having drive teeth is illustrated in FIGS. 18 and 19. To avoid repetition, some of the components, details, and reference numerals previously shown and described with reference to FIGS. 9C and 11 will not be repeated here. Other components previously described will carry the same numerals of reference.

The tail fin assembly 219 comprises a cylindrical connecting sub 263 having external threads at the front end which are received within the internal threads at the back end of the body. The sub 263 has a short reduced diameter portion forming a first shoulder and a second reduced diameter adjacent the short portion forms a second shoulder. An annular O-ring seal is provided on the first reduced diameter intermediate the first and second shoulders. The sidewall of the sub 263 extends rearwardly from the second shoulder. The rear portion 270 of the sub 263 is smaller in diameter than the second reduced diameter forming a third shoulder 268 and a fourth reduced diameter defines a fourth shoulder 271. A circumferential O-ring seal 272 is provided at back end of the sub 263. External threads 274 are provided in the rear portion 270 inwardly of the seal 272.

A series of circumferentially spaced spherical apertures 276 are formed on the circumference of the sidewall of the sub 263 near the third shoulder 271 and carry a series of balls 279. A hollow cylindrical piston 277 is slidably received on the circumference of the rear portion 270. A series of longitudinal circumferentially spaced grooves or keyways 278 are formed on the interior surface at the front portion of the piston 277 in opposed relation to the balls 279. The balls 279 within apertures 276 and keyways 278 prevent rotary motion between sub 263 and piston 277.

A first cavity 280 extends inwardly from the front end of the piston 277 and terminates in a short reduced diameter portion 281 which forms a shoulder 282. A second cavity 283 extends inwardly from the back end of the piston 277 terminating at the reduced diameter portion 281. An O-ring seal 285 is provided on the reduced diameter portion 281. As shown in FIG. 13, a series of drive teeth 86 are formed on the back end of the piston 277. The teeth 86 comprise a series of circumferentially spaced raised surfaces 87 having a straight side 88 and an angularly sloping side 89 forming a one-way ratchet configuration. A compression spring 290 surrounds the sidewall of the sub 263 and the ends of the spring are biased against the shoulder 268 of the sub 270 and the front end of the piston 277 to urge the piston outwardly from the sub.

As previously described a hollow cylindrical rotating fin sleeve 291 having a rear counterbore 296 is slidably and rotatably received on the outer periphery of sub 263. A hollow cylindrical sleeve 297 is secured within the second counterbore 296 by suitable means such as welding. The sleeve 297 has a central bore substantially the same diameter as the second cavity 283 of the piston 277. As shown in FIG. 13, a series of drive teeth 101 are formed on the front end of the sleeve 297. The teeth 101 comprise a series of circumferentially spaced raised surfaces 102 having a straight side 103 and an angularly sloping side 104 forming a one-way ratchet configuration. The teeth correspond in opposed relationship to the teeth 86 of the piston 277 for operative engagement therewith. A series of flat radially and angularly opposed fins as previously described are secured to the exterior of the fin sleeve to extend radially outward thereform.

An elongated hollow cylindrical cylinder cap 306 having internal threads 307 at the front end is slidably received within the sliding piston 277 and the sleeve 297 and threadedly secured on the external threads 274 at the rear portion 270 of the sub 263. An O-ring seal 312 is provided on the outer front portion of cap 306 and a second O-ring seal 313 is provided on the rear portion. The O-ring 312 forms a reciprocating seal on the interior of cavity 283 of piston 277 and O-ring 313 forms a rotary seal on the counterbore of fin sleeve 291. The O-ring 285 in piston 277 forms a reciprocating seal on the sidewall of cap 306.

An annular chamber 314 is formed between the exterior of the sidewall of the cap 306 and the counterbore 283 which is sealed at each end by the O-rings 285 and 312. Bushings as previously described are provided on the sub 263 and cylinder cap 306 to reduce friction therebeween. The rear portion of the cap has a threaded bore 318 at the back end of the cap 306 which receives a hose fitting (not shown) and a small passageway 319 extends inwardly from the threaded bore 318 to communicate the annular chamber 314 with a fluid or air source (not shown). A flexible hose extends outwardly of the cap 306 and is connected to the fluid or air source for effecting reciprocation of the piston 277.

The operation of the tail fin assembly 219 is best seen with reference to FIGS. 18 and 19. Compressed air or fluid in the annular cavity 314 moves the piston 277 to overcome the force of the spring 290 and move toward the front of sub 263. In the foremost position, the drive teeth 86 and 101 become disengaged. In this position (FIG. 18), compressed air or fluid is admitted through the passage 319 from the source into the annular chamber 314. The fin sleeve 291 is then free to rotate relative to the tool body.

When the air or fluid pressure within the chamber 314 is relieved, the force of the spring 290 moves the piston 277 in the opposite direction (FIG. 19). During this movement, the drive teeth 86 and 101 become engaged once again and the fin sleeve 291 becomes locked against rotational movement relative to the tool body. The cycle may be selectively repeated as necessary for proper operation of the tool.

STILL ANOTHER EMBODIMENT

Figure 21:
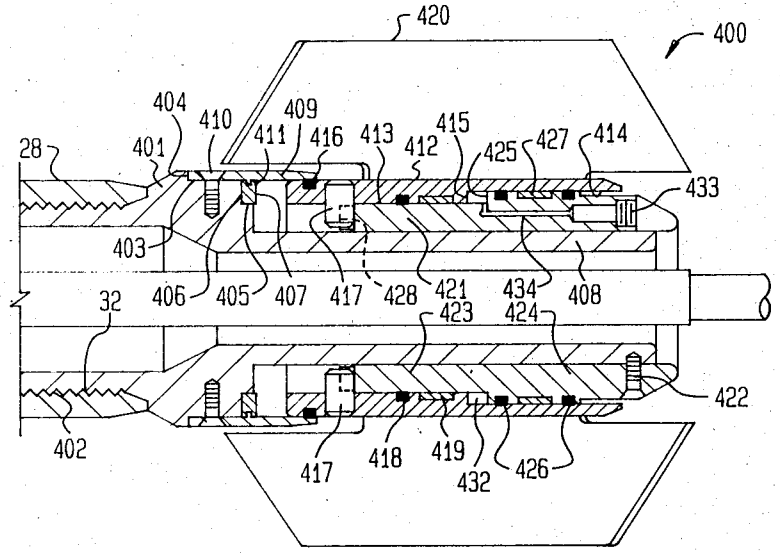
FIGS. 20 and 21 are longitudinal cross sections of an alternate embodiment of the fixed/lockable fin assembly using a drive pin arrangement.
Figure 20:
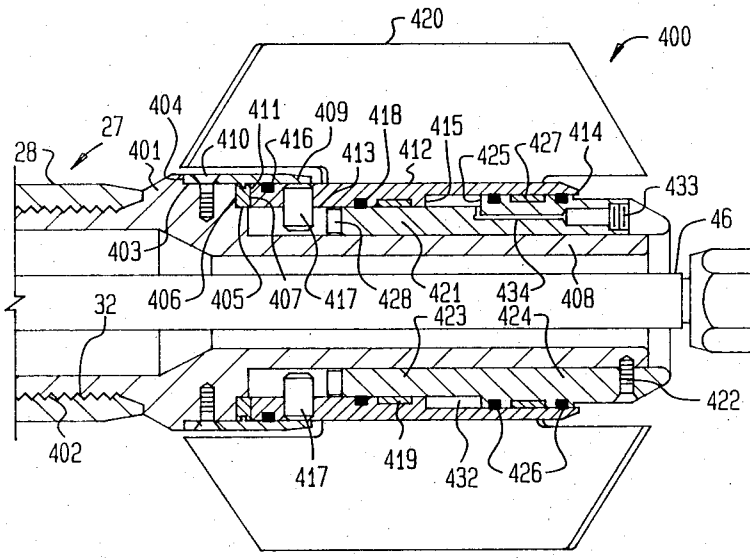

FIGS. 20 and 21 are longitudinal cross sections of an alternate embodiment of the fixed/lockable fin assembly which incorporates a drive pin arrangement in place of one of the drive teeth members previously described. It will be noted that the drive pin arrangement necessitates moving the fin sleeve along the longitudinal axis to effect fin positioning.

The tail fin assembly 400 comprises a cylindrical connecting sub 401 having external threads 402 at the front end which are received within the internal threads 32 at the rear portion of the body 28. The sub 401 has a first reduced diameter portion 403 forming a first shoulder 404 and a second reduced diameter 405 adjacent the first forms a second shoulder 406 which receives an annular seal 407. The rear portion 408 of sub 401 is smaller in diameter than the second reduced diameter 405 and extends longitudinally therefrom.

A thin cylindrical retainer ring 409 is secured on the first reduced diameter 403 of the sub 401 by screws 410 and a small annular rib 411 on the interior surface of the ring captures the seal 407 within the second shoulder 406. The rear end of ring 409 extends a short distance beyond seal 407 to surround the forward end of the rear portion 408 of the sub 401.

An elongated, hollow cylindrical rotating fin sleeve 412 is slidably and rotatably received within the extended portion of ring 409 and surrounds the rear portion 408 of sub 401. The fin sleeve 412 has a central longitudinal bore 413 and a counterbore 414 of larger diameter extending inwardly from the back end and defining an annular shoulder 415 therebetween. An O-ring seal 416 on fin sleeve 412 provides a rotary and reciprocating seal on the inner surface of ring 409. A plurality of circumferentially spaced dowel pins 417 extend radially inwardly through the side wall of the fin sleeve 412 and terminate a short distance from the circumference of the rear portion 408 of the sub 401. An annular O-ring seal 418 and a bushing 419 is provided on the interior surface of the fin sleeve 412 intermediate the dowel pins 417 and shoulder 415.

A series of radially and angularly opposed fins 420 are secured to the exterior of the rotating fin sleeve 412 to extend radially outward therefrom. The fins are secured at opposing angles relative to the longitudinal axis of the sleeve 412 to impart a rotational force on the sleeve. An elongated hollow cylindrical cap 421 is slidably received on the sub rear portion 408 within fin sleeve 412 and secured to sub 401 by means of a screw 422 at the rear portion thereof. The cap 421 has a reduced diameter front portion 423 and an enlarged diameter rear portion 424 forming a shoulder 425. A pair of longitudinally spaced O-rings 426 are positioned on the rear portion 424 and a bushing 427 is provided intermediate the O-rings 426. The enlarged diameter rear portion 424 of the cap 421 is rotatably received within counterbore 414 with the O-rings 426 providing a rotary seal therebetween.

Figure 22:
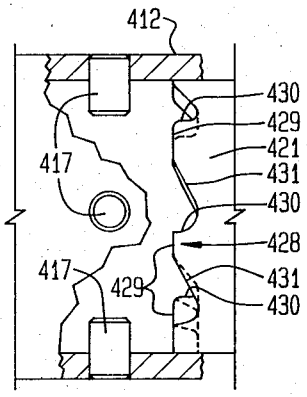
FIG. 22 is a partial elevation of the dowel pin and drive teeth of the fixed/lockable tail fin assembly.

As shown in FIGS. 20, 21, and 22, a series of drive teeth 428 are formed on the front end of the cap 421. The drive teeth 428 comprise a series of circumferentially spaced raised surfaces 429, each having a generally straight side 430 and an angularly sloping side 431 forming a one-way ratchet configuration. The spacing of the drive teeth 428 relative to the dowel pins 417 is such that the pins will be retained by the teeth in the locked position to prevent rotary motion between the fin sleeve 412 and cap 421 as described hereinafter.

When properly positioned, an annular chamber 432 is formed between the shoulder 415 of the fin sleeve and the shoulder 425 of the cap and sealed at each end by the O-rings 418 and 426. A threaded bore 433 at the back end of the cap 421 receives a hose fitting (not shown) and a small passageway 434 extends inwardly from the threaded bore to communicate the annular chamber 432 with a fluid or air source (not shown) for reciprocating fin sleeve 412.

The operation of the tail fin assembly with dowel pins is best seen with reference to FIGS. 20, 21, and 22. Compressed air or fluid in the annular chamber 432 moves the fin sleeve 412 toward the front of the sub 401. In the foremost position, the front end of the sleeve 412 contacts the seal 407 and the dowel pins 417 disengage from the drive teeth 428. In this position (FIG. 20), compressed air or fluid is admitted through the passage 434 from the source into the annular chamber 432. The fin sleeve 412 is then free to rotate relative to the tool body.

When the air or fluid pressure within the chamber 432 is relieved, the driving force of the tool hammer carries the tool including the cap 421 forward (FIG. 21). During this movement, drive teeth 428 and dowel pins 417 become engaged once again and fin sleeve 412 becomes locked againt rotational movement relative to the tool body. The cycle may be selectively repeated as necessary for proper alignment of the slanted nose member and attitude adjustment of the tool.

A FURTHER EMBODIMENT

Figure 23:
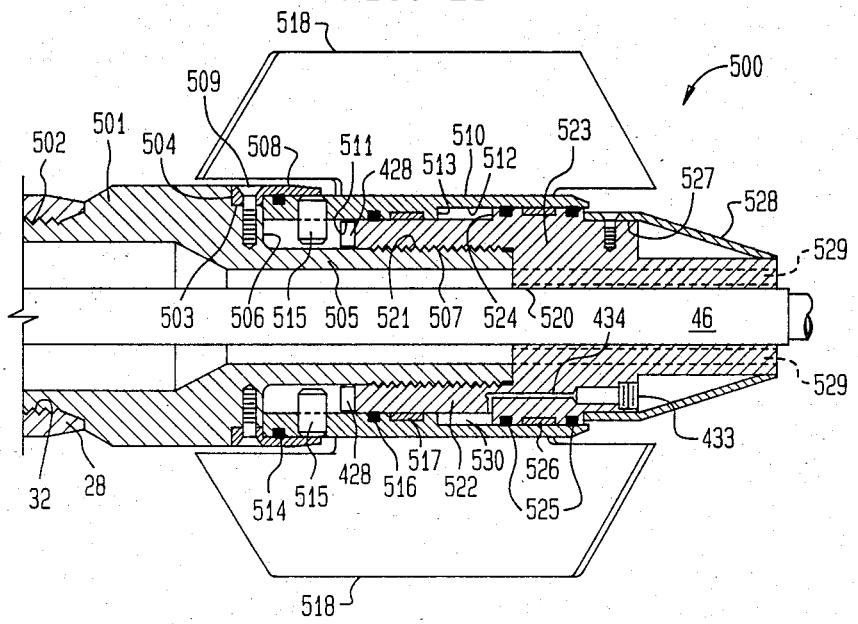
Figure 24:
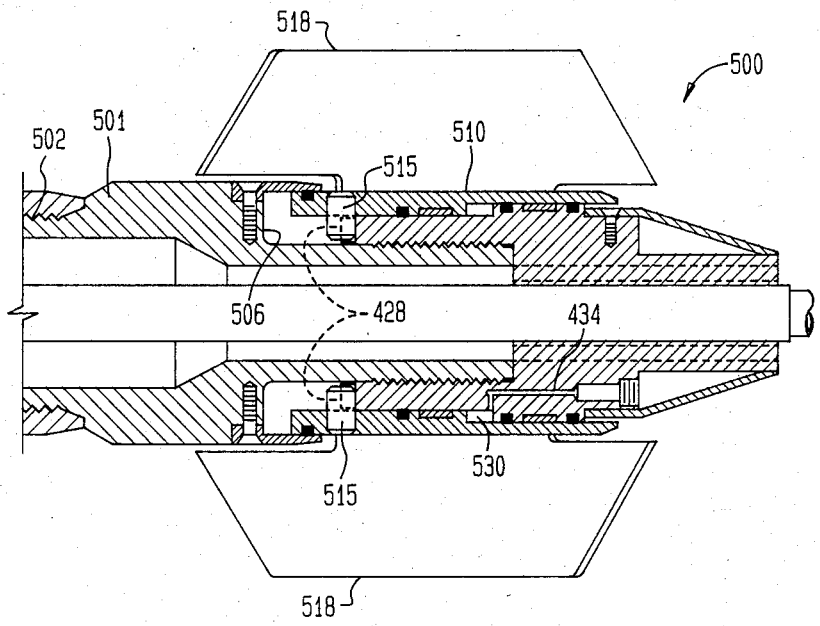

FIGS. 23 and 24 are partial longitudinal cross sections of variations of the fixed/lockable fin assembly using a drive pin. The tail fin assembly 500 comprises a cylindrical connecting sub 501 having external threads 502 at the front end which are received within the internal threads 32 at the rear portion of the body 28. The sub 501 has a first reduced diameter portion 503 forming a shoulder 504. The rear portion 505 of the sub 501 is smaller in diameter than the first reduced diameter 503 forming a second shoulder 506. The rear portion 505 extends longitudinally from shoulder 506 and has exterior threads 507 at the back end.

A thin cylindrical retainer ring 508 is received on the first reduced diameter 503 of sub 501 by screws 509. The rear end of ring 508 extends a short distance beyond the shoulder 506 to surround the forward end of the rear portion 505 of the sub 501.

An elongated hollow cylindrical rotating fin sleeve is slidably and rotatably received within the extended portion of ring 508 and surrounds the rear portion 505 of sub 501. The fin sleeve 510 has a central longitudinal bore 511 and a counterbore 512 of larger diameter extending inwardly from the back end and defining an annular shoulder 513. An O-ring seal 514 on the fin sleeve 510 provides a rotary and reciprocating seal on the inner surface of the ring 508. A plurality of circumferentially spaced dowel pins 515 extend radially inwardly through the side wall of the fin sleeve 510 and terminate a short distance from the circumference of the rear portion 505 of the sub 501. An O-ring seal 516 and a bushing 517 are positioned on the interior surface of fin sleeve 410 intermediate the dowel pins 515 and shoulder 513.

A plurality of radially and angularly opposed fins 518 are secured to the exterior of the rotating fin sleeve 510 and extend radially outward therefrom. The fins 518 are secured at opposing angles relative to the longitudinal axis of the sleeve 510 to impart a rotational force on the sleeve.

A tubular cap 519 having a central bore 520 and a threaded counterbore 521 extending inwardly from the front end is slidably received on the air distribution tube 46 and the sub rear portion 505 within the fin sleeve 510. The cap 519 is threadedly received and secured on the threads 507 at the end of the sub 501. The cap 519 has a reduced diameter front portion 522 and an enlarged diameter rear portion 523 forming a shoulder 524 therebetween. A pair of longitudinally spaced O-rings 525 are provided on the rear portion 523 and a bushing 526 is provided intermediate the O-rings 525.

The enlarged diameter rear portion 523 of cap 519 is rotatably received within the counterbore 512 with the O-rings 525 providing a rotary seal. As previously shown and described with reference to FIG. 22, a plurality of drive teeth 428 are formed on the front end of the cap 519. The rear portion 523 of the cap 519 has a reduced diameter portion 527 which removably receives a conical cover member 528. A plurality of circumferentially spaced longitudinal bores 529 extend through the rear portion of the cap 519 for communicating the interior of the body 28 with atmosphere. The drive teeth are constructed and operate as previously described for the other embodiments.

When properly positioned, an annular chamber 530 is formed between the shoulder 513 of the fin sleeve and the shoulder 524 of the cap and sealed at each end by the O-rings 516 and 524. A threaded bore 433 at the back end of the cap 519 receives a hose fitting (not shown) and a small passageway 434 extends inwardly from the threaded bore to communicate the annular chamber 530 with a fluid or air source (not shown) for effecting reciprocation of the fin sleeve 510.

The operation of the tail fin assembly with dowel pins and drive teeth is best seen with reference to FIGS. 23 and 24. Compressed air or fluid in the annular chamber 530 moves the fin sleeve 510 toward the front of the sub 501. In its foremost position, the front end of the sleeve 510 contacts the shoulder 506 and the dowel pins 515 disengage from the drive teeth 428. In this position (FIG. 23), compressed air or fluid is admitted through the passage 434 from the source into the annular chamber 530. The fin sleeve 510 is then free to rotate relative to the tool body.

When the air or fluid pressure within the chamber 530 is relieved, the driving force of the tool hammer carries the tool including the cap 519 forward (FIG. 24). During this movement, the drive teeth 428 and dowel pins 515 engage once again and the fin sleeve 510 is locked against rotational movement relative to the tool body. The cycle may be selectively repeated as necessary for proper alignment of the slanted nose member and attitude adjustment of the tool.

A STILL FURTHER EMBODIMENT

Figure 25:
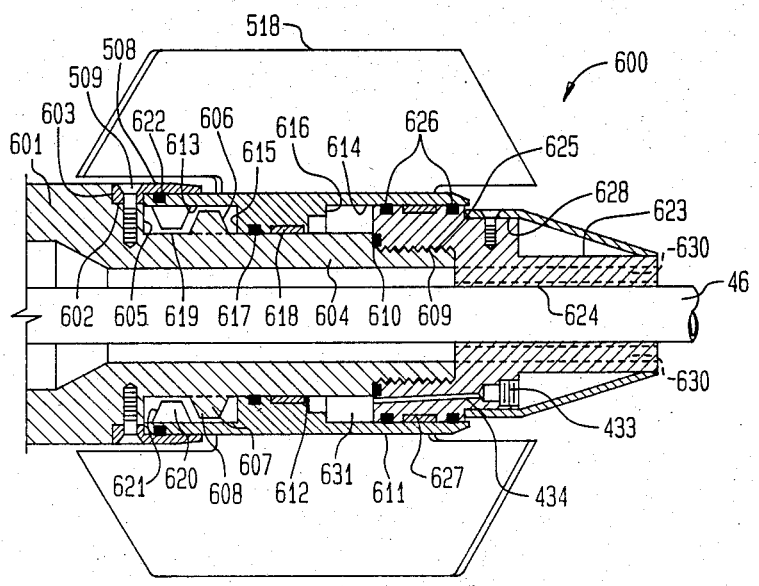
FIGS. 25 and 26 illustrate a splined connection.
Figure 26:
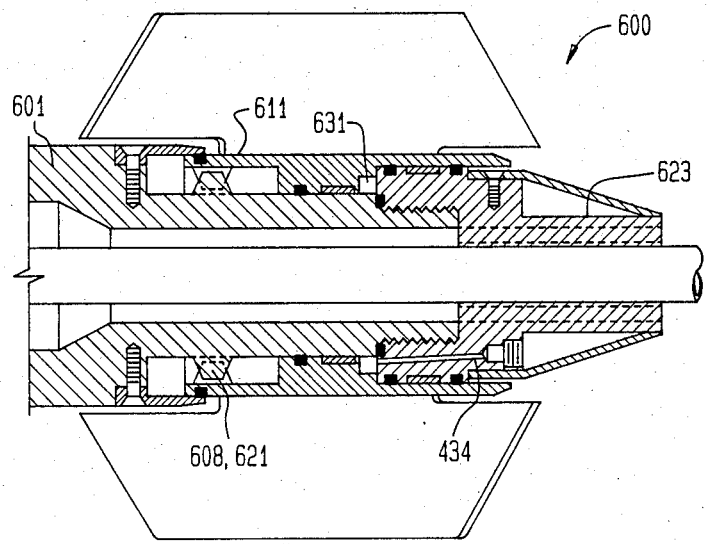

FIGS. 25 and 26 are partial longitudinal cross sectional views of a variation of the fixed/lockable fin assembly using an interlocking lug arrangement to prevent rotational movement. The tail fin assembly 600 comprises a cylindrical connecting sub 601 having external threads at the front end which are received within the internal threads at the rear portion of the body (not shown). The circumference of the sub 601 has a first reduced diameter portion 602 forming a first shoulder 603. The rear portion 604 of the sub 661 is smaller in diameter than the first reduced diameter 602 forming a second shoulder 605. An annular raised surface 606 on the rear portion 604 is spaced rearwardly from the shoulder 605 and provided with a series of circumferentially spaced slots 607 forming a series of raised lugs or splines 608. The rear portion 604 extends longitudinally from the lugs 608 and is provided with exterior threads 609 at the back end. An annular O-ring seal 610 is provided on the rear portion 604 inwardly of the threads 609.

A thin cylindrical retainer ring 508 is received on the first reduced diameter 602 of the sub 601 by screws 509. The rear end of the ring 508 extends a short distance beyond the shoulder 605 to surround the forward end of the rear portion 604 of the sub 601.

An elongated hollow cylindrical rotating fin sleeve 611 is slidably and rotatably received within the extended portion of the ring 508 and surrounds the rear portion 604 of the sub 601. The fin sleeve 611 has a central longitudinal bore 612, a front and rear counterbore 613 and 614 respectively of larger diameter extending inwardly from each end and defining annular shoulders 615 and 616 therebetween. An annular O-ring seal 617 and annular bushing 618 are disposed on central bore 612 intermediate the shoulders 615 and 616. A reduced diameter 619 is provided on the inner diameter of the front counterbore 613 near the front end and provided with a series of circumferentially spaced slots 620 forming a series of raised lugs or splines 621. An O-ring seal 622 on the outer circumference of the fin sleeve 611 provides a rotary and reciprocating seal on the inner surface of the ring 508.

A plurality of radially and angularly opposed fins 518 are secured to the exterior of the rotating fin sleeve 611 to extend radially outward therefrom. The fins 518 are secured at opposing angles relative to the longitudinal axis of the sleeve 611 to impart a rotational force on the sleeve.

An elongated hollow cylindrical cap 623 having a central bore 624 and a larger threaded bore 625 extending inwardly from the front end is slidably received on the air distribution tube 46 and threadedly secured on the threads 609 at the end of the sub 601. The outer circumference of the cap 623 is received within the rear counterbore 614 of the fin sleeve 611. A pair of longitudinally spaced annular O-rings 626 are provided on the outer circumference of the cap 623 and a bushing 627 is provided intermediate the O-rings 626. The outer circumference of the cap 623 is rotatably received within the counterbore 614 with the O-rings 626 providing a rotary seal therebetween. The rear portion of the cap 623 has a reduced diameter portion 628 which removably receives a conical cover member 629. A plurality of circumferentially spaced longitudinal bores 630 extend through the rear portion of the cap for communicating the interior of the tool body with atmosphere.

When properly positioned, an annular chamber 631 is formed between the shoulder 616 of the fin sleeve and the forward end of the cap 623 and sealed at each end by the O-rings 610, 617, and 626. A threaded bore 433 at the back end of the cap 623 receives a hose fitting (not shown) and a small passageway 434 extends inwardly from the threaded bore to communicate the annular chamber 631 with a fluid or air source (not shown) for effecting reciprocation of the fin sleeve.

The operation of the tail fin assembly 600 is best seen with reference to FIGS. 25 and 26. Under action of compressed air or fluid in the annular chamber 631 the fin sleeve 611 begins to move toward the front of the sub 601. When in its foremost position, the front end of the sleeve 611 contacts the shoulder 605 and the lugs 608 and 621 become disengaged. In this position (FIG. 25), compressed air or fluid is admitted through the passage 434 from the source into the annular chamber 631. The fin sleeve 611 is then free to rotate relative to the tool body.

When the air or fluid pressure within the chamber 631 is relieved, the driving force of the tool hammer carries the tool including the cap 623 forward (FIG. 26). During this movement, the drive lugs or splines 608 and 621 become engaged once again and the fin sleeve 611 becomes locked against rotational movement relative to the tool body. The cycle may be selectively repeated as necessary for proper alignment of the slanted nose member and attitude adjustment of the tool.

A STILL FURTHER EMBODIMENT

Figure 27:
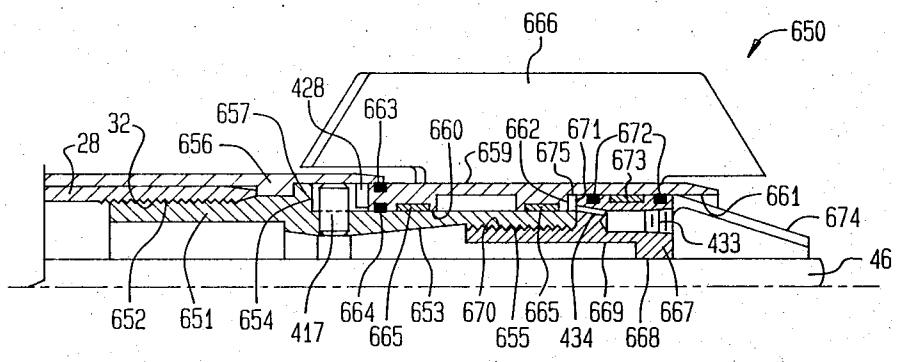
Figure 28:
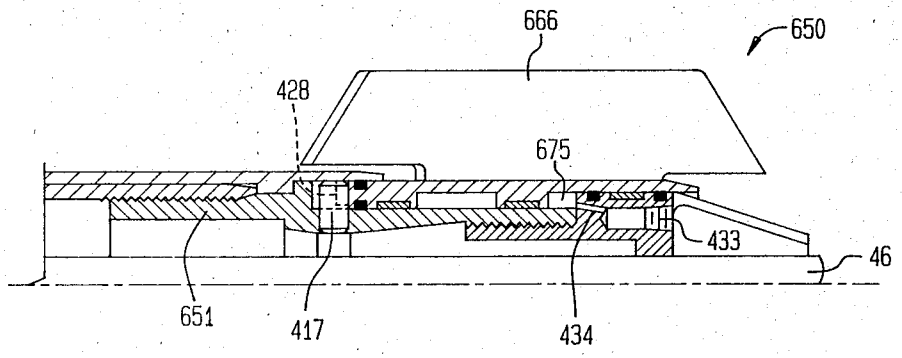

FIGS. 27 and 28 are partial longitudinal cross sections of another variation of the fixed/lockable fin assembly using a drive pin. The tail fin assembly 650 comprises a cylindrical connecting sub 651 having external threads 652 at the front end which are received within the internal threads 32 at the rear portion of the body 28. The rear portion 653 of the sub 651 is smaller in diameter than the front portion forming a shoulder 654. The rear portion 653 extends longitudinally from the shoulder 654 and has interior threads 655 at the back end.

A thin cylindrical retainer ring 656 is received on the front portion of the sub 651 between a raised shoulder 657 and the back end of the body 28. The rear end of the ring 656 extends a short distance beyond the raised shoulder 657 to surround the forward end of the rear portion 653 of the sub 651. A plurality of circumferentially spaced dowel pins 417 extend radially outward through the side wall of the rear portion 653 and terminate a short distance from the interior surface of the ring 656.

An elongated hollow cylindrical rotating fin sleeve 659 is slidably and rotatably received within the extended portion of the ring 656 and surrounds the rear portion 653 of the sub 651 including the dowel pins 417. The fin sleeve 659 has a central longitudinal bore 660 and a counterbore 661 of larger diameter extending inwardly from the back end and defining an annular shoulder 662 therebetween. An O-ring seal 663 on the outer circumference of the fin sleeve 659 provides a rotary and reciprocating seal on the inner surface of the ring 656. An annular O-ring seal 664 and a pair of bushings 665 are provided on the interior surface of the fin sleeve 659. A plurality of drive teeth 428 (as previously shown and described) are formed on the front end of the fin sleeve 659.

A plurality of radially and angularly opposed fins 666 are secured to the exterior of the rotating fin sleeve 659 to extend radially outward therefrom. The fins 666 are secured at opposing angles relative to the longitudinal axis of the sleeve 659 to impart a rotational force on the sleeve.

An elongated hollow cylindrical cap 667 having a central bore 668 and a counterbore 669 extending inwardly from the front end is slidably received on the air distribution tube 46 within the fin sleeve 659. Exterior threads 670 are provided on the front portion of the cap 667 which are received on the threads 655 at the back end of the sub 651. The rear portion of the cap 667 is larger in diameter than the threaded front portion forming a shoulder 671 therebetween. A pair of longitudinally spaced annular O-rings 672 are provided on the outer circumference of the rear portion and a bushing 673 is provided intermediate the O-rings. The enlarged diameter rear portion of the cap 667 is rotatably received within the counterbore 661 with the O-rings 672 providing a rotary seal therebetween. The rear portion of the cap 667 removably receives a conical cover member 674. To avoid repetition, the detailed description of the drive teeth and their operation will not be repeated here.

When properly positioned, an annular chamber 675 is formed between the shoulder 662 of the fin sleeve and the shoulder 671 of the cap and sealed at each end by the O-rings 663 and 672. A threaded bore 443 at the back end of the cap 667 receives a hose fitting (not shown) and a small passageway 434 extends inwardly from the threaded bore to communicate the annular chamber 675 with a fluid or air source (not shown) for effecting reciprocation of the fin sleeve 659. FIG. 28 shows the locked position, and since the operation of the tail fin assembly has been previously shown and explained, it will not be repeated here.

A STILL FURTHER EMBODIMENT

Figure 29:
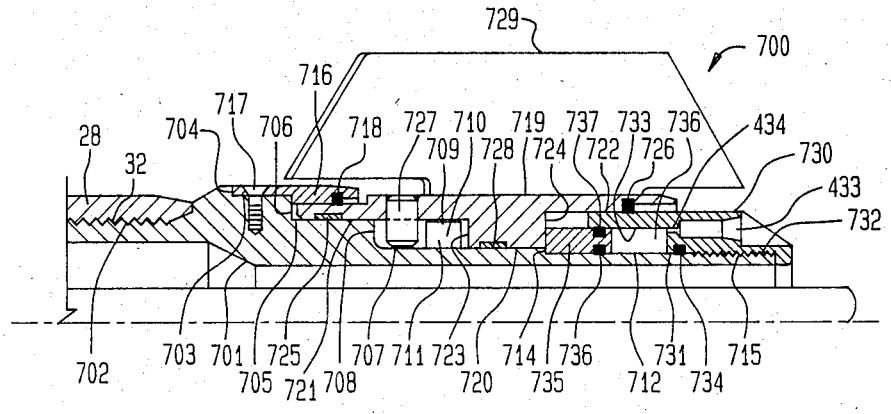
FIGS. 29-32 show a spline and drive teeth connection.
Figure 30:
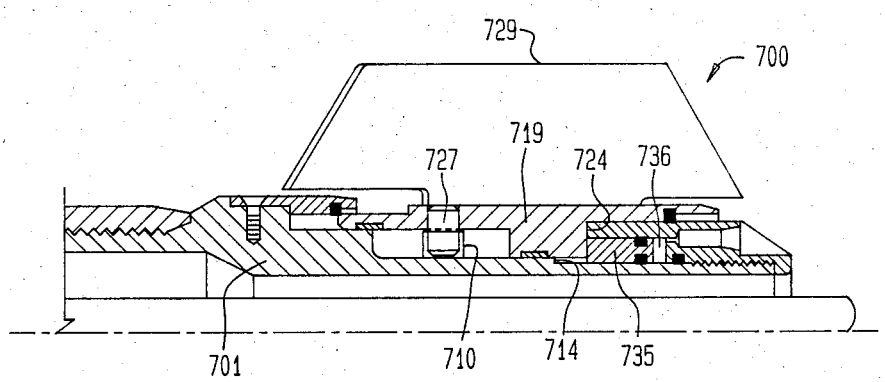

FIGS. 29 and 30 are partial longitudinal cross sections of another variation of the fixed/lockable fin assembly using a series of slots or splines and dowel pins to prevent rotational movement. The tail fin assembly 700 comprises a cylindrical connecting sub 701 having external threads 702 at the front end which are received within the internal threads 32 at the rear portion of the body 28. The circumference of the sub 701 has a first reduced diameter portion 703 forming a first shoulder 704 therebetween. A second reduced diameter 705 forms a second shoulder 706. A third reduced diameter 707 forms a third reduced diameter 708. An enlarged diameter 709 approximately the same diameter as the second is spaced therefrom and provided with a series of circumferentially spaced slots 710 defining a series of raised lugs or splines 711 on the third reduced diameter 707. A fourth diameter 712 smaller than the third forms a fourth shoulder 714 therebetween. The fourth diameter 712 extends longitudinally from the shoulder 714 and is provided with exterior threads 715 at the back end.

A thin cylindrical retainer ring 716 is received on the first reduced diameter 703 of the sub 701 by screws 717. The rear end of the ring 716 extends a short distance beyond the shoulder 706 to surround the forward end of the reduced diameter 705. A rod wiper 718 is contained on the interior of the rear end of the ring 716.

An elongated hollow cylindrical rotating fin sleeve 719 is slidably and rotatably received within the extended portion of the ring 716 and surrounds the rear portion of the sub 701. The fin sleeve 719 has a central longitudinal bore 720, a front and rear counterbore 721 and 722 respectively of larger diameter extending inwardly from each end and defining annular shoulders 823 and 724 therebetween. An annular bushing 725 is disposed on the inner diameter of the counterbore 721 and a rod wiper 726 is provided on the inner diameter of the counterbore 722. A plurality of circumferentially spaced dowel pins 727 extend radially inwardly through the side wall of the fin sleeve 719 and terminate a short distance from the circumference of the third reduced diameter 707 of the sub 701. An annular bushing 728 is provided on the central bore 720 intermediate the shoulders 723 and 724.

A plurality of radially and angularly opposed fins 729 are secured to the exterior of the rotating fin sleeve 719 to extend radially outward therefrom. The fins 729 are secured at opposing angles relative to the longitudinal axis of the sleeve 719 to impart a rotational force on the sleeve.

An elongated hollow cylindrical cap 730 having a central bore 731 provided with interior threads 732 and a counterbore 733 extending inwardly from the front end is received on the threads 715 of the sub 701 and within the counterbore 722 of the fin sleeve 719. An annular O-ring 734 on the bore 731 provides a seal on the fourth reduced diameter 712 of the sub 701. A cylindrical reciprocating piston 735 is slidably received on the fourth reduced diameter 712 of the sub 701 and within the counterbore 733 of the cap 730. Annular O-rings 736 and 737 are provided on the inner and outer diameters respectively of the piston 735.

With the piston 735 properly positioned, an annular chamber 736 is formed between the fourth reduced diameter 712 and the counterbore 733 and sealed at each end by the O-rings 734, 736 and 737. A threaded bore 433 at the back end of the cap 730 receives a hose fitting (not shown) and a small passageway 434 extends inwardly from the threaded bore to communicate the annular chamber 736 with a fluid or air source (not shown) for effecting reciprocation of the piston 735 and fin sleeve 719.

The operation of the tail fin assembly 700 is best seen with reference to FIGS. 29 and 30. Under action of compressed air or fluid in the annular chamber 736 the piston 735 begins to move toward the front of the sub 701 and contacts the shoulder 724 of the fin sleeve 719 carrying it forward. When in its foremost position, the front end of the piston 735 contacts the shoulder 714 and the dowel pins 727 become disengaged from the slots or splines 810. In this position (FIG. 29), compressed air or fluid is admitted through the passage 434 from the source into the annular chamber 736. The fin sleeve 719 is then free to rotate relative to the tool body.

When the air or fluid pressure within the chamber 736 is relieved, the driving force of the tool hammer carries the tool including the sub 701 forward relative to the fin sleeve 719 (FIG. 24). During this movement, the shoulder 724 moves the piston rearwardly and the dowel pins 727 become engaged once again in the slots 710 and the fin sleeve 719 becomes locked against rotational movement relative to the tool body. The cycle may be selectively repeated as necessary for proper alignment of the slanted nose member and attitude adjustment of the tool.

A STILL FURTHER EMBODIMENT

Figure 31:
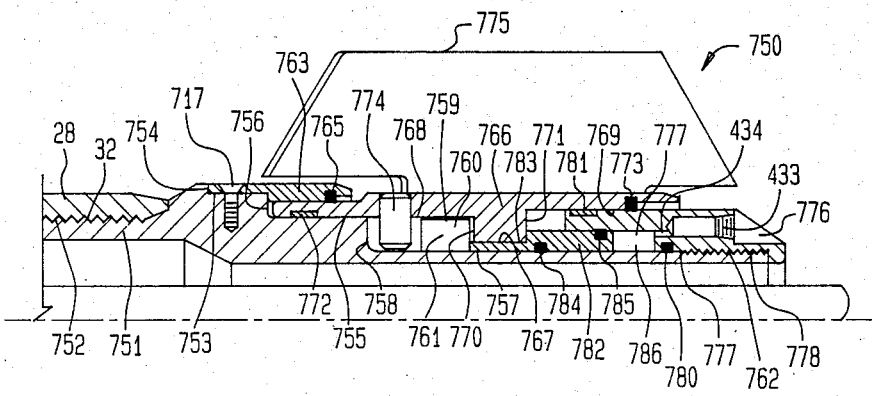
Figure 32:
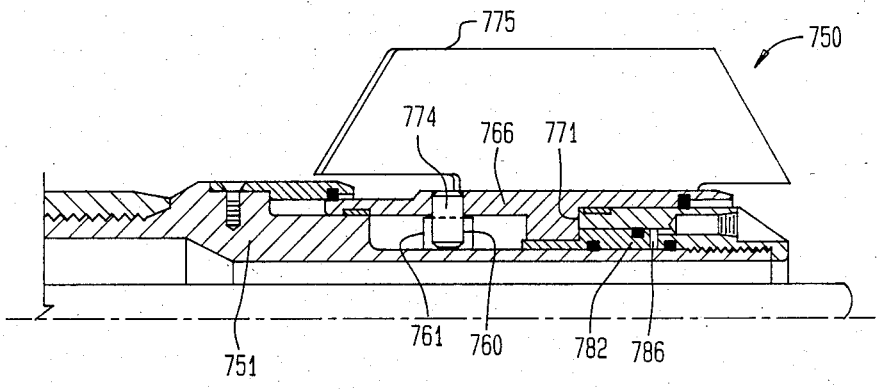

FIGS. 31 and 32 are partial longitudinal cross sections of another variation of the fixed/lockable fin assembly using a series of slots or splines and dowel pins to prevent rotational movement. The tail fin assembly 750 comprises a cylindrical connecting sub 751 having external threads 752 at the front end which are received within the internal threads 32 at the rear portion of the body 28. The circumference of the sub 751 has a first reduced diameter portion 753 forming a first shoulder 754 therebetween. A second reduced diameter 755 forms a second shoulder 906. A third reduced diameter 757 forms a third shoulder 758. An enlarged diameter 759 approximately the same diameter as the second is spaced therefrom and provided with a series of circumferentially spaced slots 760 defining a series of raised lugs or splines 761 on the third reduced diameter 757. The third diameter 757 extends longitudinally from the lugs or splines 761 and is provided with exterior threads 762 at the back end.

A thin cylindrical retainer ring 763 is received on the first reduced diameter 753 of the sub 751 by screws 754. The rear end of the ring 763 extends a short distance beyond the shoulder 756 to surround the forward end of the reduced diameter 755. A rod wiper 765 is contained on the interior of the rear end of the ring 763.

An elongated hollow cylindrical rotating fin sleeve 766 is slidably and rotatably received within the extended portion of the ring 763 and surrounds the rear portion of the sub 751. The fin sleeve 766 has a central longitudinal bore 767, a front and rear counterbore 768 and 769 respectively of larger diameter extending inwardly from each end and defining annular shoulders 770 and 771 therebetween. An annular bushing 772 is disposed on the inner diameter of the counterbore 768 and a rod wiper 773 is provided on the inner diameter of the rear counterbore 769. A plurality of circumferentially spaced dowel pins 774 extend radially inwardly through the side wall of the fin sleeve 766 and terminate a short distance from the circumference of the third reduced diameter 757 of the sub 751.

A plurality of radially and angularly opposed fins 775 are secured to the exterior of the rotating fin sleeve 766 to extend radially outward therefrom. The fins 775 are secured at opposing angles relative to the longitudinal axis of the sleeve 766 to impart a rotational force on the sleeve.

An elongated hollow cylindrical cap 776 having a central bore 777 provided with interior threads 778 and a counterbore 779 extending inwardly from the front end is received on the threads 762 of the sub 751 and within the counterbore 769 of the fin sleeve 766. An annular O-ring 780 on the bore 777 provides a seal on the third reduced diameter 757 of the sub 751. An annular bushing 781 is provided on the circumference of the cap 776. A cylindrical reciprocating piston 782 is slidably received on the third reduced diameter 757 of the sub 751 and within the counterbore 769 of the cap 776. A reduced diameter 783 at the front end of the piston is received within the central bore 767 of the fin sleeve 766. Annular O-rings 784 and 785 are provided on the inner and outer diameters respectively of the piston 781.

With the piston 781 properly positioned, an annular chamber 786 is formed between the circumference of the sub 751 and counterbore 777 and sealed at each end by the O-rings 780, 784 and 785. A threaded bore 433 at the back end of the cap 786 receives a hose fitting (not shown) and a small passageway 434 extends inwardly from the threaded bore to communicate the annular chamber 785 with a fluid or air source (not shown) for effecting reciprocation of the piston 782 and fin sleeve 766.

The operation of the tail fin assembly 750 is best seen with reference to FIGS. 31 and 32. Under action of compressed air or fluid in the annular chamber 786 the piston 782 begins to move toward the front of the sub 751 and carries the fin sleeve 766 with it. When in its foremost position, the front end of the piston 782 contacts the lugs or splines 761 and the dowel pins 774 become disengaged from the slots 760. In this position (FIG. 31), compressed air or fluid is admitted through the passage 434 from the source into the annular chamber 786. The fin sleeve 766 is then free to rotate relative to the tool body.

When the air or fluid pressure within the chamber 786 is relieved, the driving force of the tool hammer carries the tool including the sub 751 forward relative to the fin sleeve 766 (FIG. 32). During this movement, the shoulder 771 moves the piston rearwardly and the dowel pins 774 become engaged once again in the slots or splines 760 and the fin sleeve 766 becomes locked against rotational movement relative to the tool body. The cycle may be selectively repeated as necessary for proper alignment of the slanted nose member and attitude adjustment of the tool.

A STILL FURTHER EMBODIMENT

Figure 33:
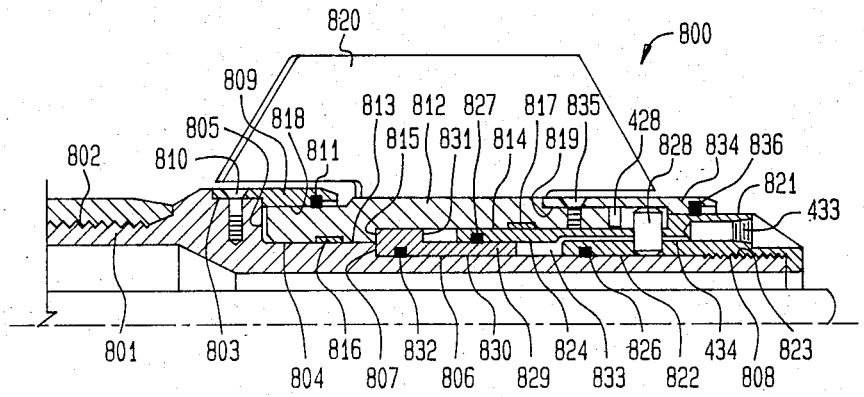
Figure 34:
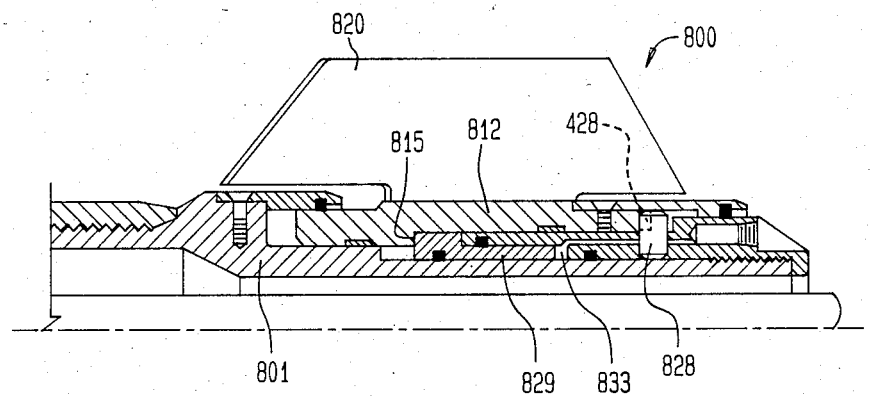

FIGS. 33 and 34 are partial longitudinal cross sections of another variation of the fixed/lockable fin assembly using a series of dowel pins and drive teeth to prevent rotational movement. The tail fin assembly 800 comprises a cylindrical connecting sub 801 having external threads 802 at the front end which are received within the internal threads at the rear portion of the tool body. The circumference of the sub 801 has a first reduced diameter portion 803, and a second reduced diameter 804 forms a shoulder 805 therebetween. A third reduced diameter 806 forms a third shoulder 807. The third diameter 806 extends longitudinally from the shoulder 807 and is provided with exterior threads 808 at the back end.

A thin cylindrical retainer ring 809 is received on the first reduced diameter 803 of the sub 801 by screws 810. The rear end of the ring 809 extends a short distance beyond the shoulder 805 to surround the forward end of the reduced diameter 804. A rod wiper 811 is obtained on the interior of the rear end of the ring 809.

An elongated hollow cylindrical rotating fin sleeve 812 has a central longitudinal bore 813, and a rear counterbore 814 of larger diameter extending inwardly from the back end and defining an annular shoulder 815 therebetween. An annular bushing 816 is provided on the central bore and another bushing 817 is provided on the counterbore 814. The outer circumference of the fin sleeve 812 is provided with front reduced diameter 818 and a rear reduced diameter 819. The fin sleeve 812 is slidably and rotatably received on the sub 801 with the central bore 813 on the second reduced diameter 804 and the front reduced diameter 818 within the extended portion of the ring 809. A series of drive teeth 428 previously shown and described with reference to FIG. 22 are formed on the back end of the fin sleeve 812.

A plurality of radially and angularly opposed fins 820 are secured to the exterior of the rotating fin sleeve 812 to extend radially outward therefrom. The fins 820 are secured at opposing angles relative to the longitudinal axis of the sleeve 812 to impart a rotational force on the sleeve.

An elongated hollow cylindrical cap 821 having a central bore 822 provided with interior threads 823 and a counterbore 824 extending inwardly from the front end and defining a shoulder 825 therebetween is received on the threads 808 of the sub 801 and within the counterbore 814 of the fin sleeve 812. An annular O-ring 826 on the bore 822 provides a seal on the third reduced diameter 806 of the sub 801, and another O-ring 827 on the counterbore 814 provides a seal on the reduced portion of a piston member described hereinafter. A plurality of circumferentially spaced dowel pins 828 extend radially outward through the side wall of the fin sleeve 812 (shown out of position).

A cylindrical reciprocating piston 829 is slidably received on the third reduced diameter 806 of the sub 801. The rear portion 830 of the piston 829 is smaller in diameter than the outer circumference defining a shoulder 831 therebetween. The outer circumference of the piston 829 is received in the annulus between the third reduced diameter 806 and the fin sleeve counterbore 814 and the rear portion 830 is received in the annulus between the third reduced diameter 806 and the counterbore 824 of the cap 821. An annular O-ring 832 is provided on the inner diameter of the piston 829. With the piston 829 properly positioned, an annular chamber 833 is formed between the back end of the piston and the counterbore 824 of the cap 821 and sealed by the O-rings 826, 827, and 832.

A threaded bore 433 at the back end of the cap 821 receives a house fitting (not shown) and a small passageway 434 extends inwardly from the threaded bore to communicate the annular chamber 833 with a fluid or air source (not shown) for effecting reciprocation of the piston 829 and fin sleeve 812.

A second thin cylindrical retainer ring 834 is secured on the rear reduced diameter 819 of the fin sleeve 812 by screws 835 and extends rearwardly to surround the drive teeth 428 and the dowel pins 828. The rear end of the ring 834 extends a distance beyond the dowel pins 828 and is provided with a rod wiper 836.

The operation of the tail fin assembly 800 is best seen with reference to FIGS. 33 and 34. Under action of compressed air or fluid in the annular chamber 833 the piston 829 begins to move toward the front of the sub 801 contacting the shoulder 815 and carrying the fin sleeve 812 with it. When in its foremost position, the front end of the piston 829 contacts the shoulder 815 and the drive teeth ecome disengaged from the dowel pins 828. In this position (FIG. 33), compressed air or fluid is admitted through the passage 434 from the source into the annular chamber 833. The fin sleeve 812 is then free to rotate relative to the tool body.

When the air or fluid pressure within the chamber 833 is relieved, the driving force of the tool hammer carries the tool including the sub 801 forward relative to the fin sleeve 812 (FIG. 34). During this movement, the shoulder 815 moves the piston rearwardly and the drive teeth 428 become engaged once again with the dowel pins 828 and the fin sleeve 812 becomes locked against roational movement relative to the tool body. The cycle may be selectively repeated as necessary for proper alignment of the slanted nose member and attitude adjustment of the tool.

A STILL FURTHER EMBODIMENT

Figure 36:
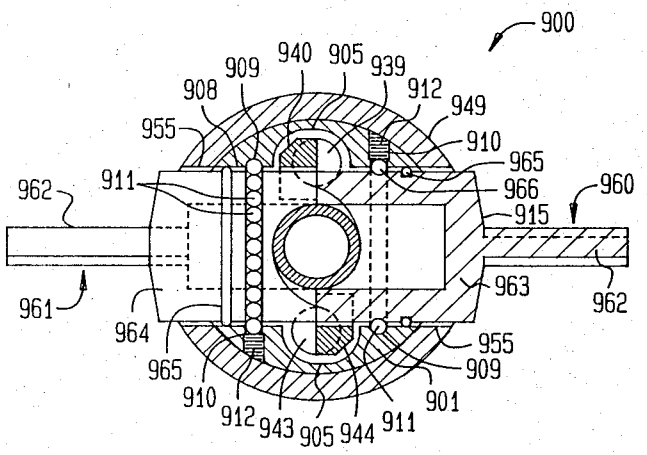
FIG. 36 is a vertical cross section of the movable tail fin assembly of FIG. 35 taken along line 36—36 of FIG. 35.
Figure 35:
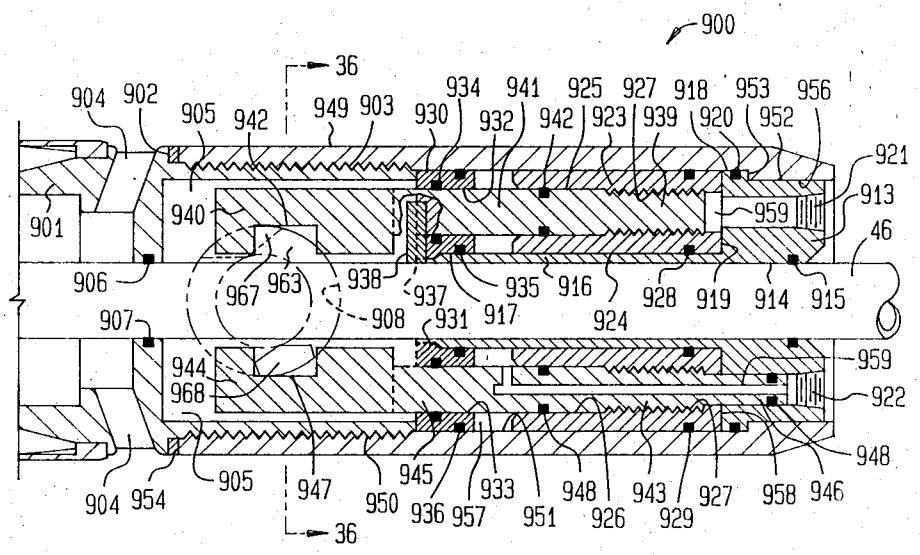
FIG. 35 is a longitudinal cross section of a movable tail fin assembly.
Figure 39:
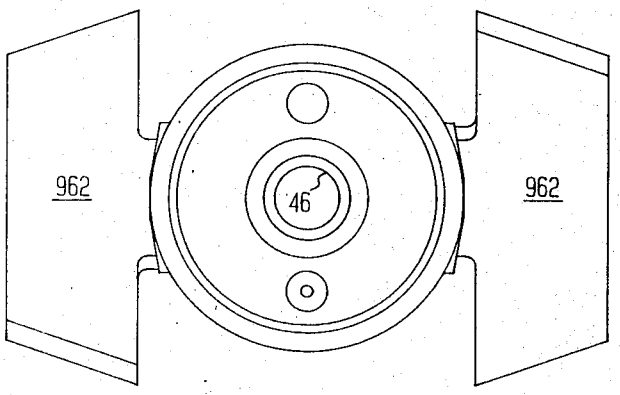
FIG. 39 is an end view of the movable tail fin assembly showing the fins in the non-parallel position.

FIG. 35 is a longitudinal cross sectional view of a movable tail fin assembly. FIG. 36 is a vertical cross sectional view of the movable tail fin assembly of FIG. 35 taken along line 36—36 of FIG. 35. The movable tail fin arrangement is similar to the fixed/lockable tail fins previously described with the exception that it rotates the boring tool through an inclined, anti-parallel or skewed fin arrangement. When the two fins are parallel, the soil forces acting on their faces prevents rotation of the tool housing and allows the nose member or eccentric hammer to produce a net deflective force which causes the tool to veer in a curved trajectory.

The movable tail fin assembly 900 comprises a cylindrical connecting sub 901 having external threads at the front end which are received within the internal threads at the rear portion of the tool body. The outer rear portion of the sub 901 is reduced in diameter defining a shoulder 902 and provided with external threads 903. A series of circumferentialy spaced openings 904 extend radially through the side wall of the sub 901 communicating the interior of the tool to atmosphere. A pair of opposed J-slots 905 extend longitudinally inward from the back end of the sub 901 and terminate a distance from the openings 904. An annular o-ring seal 906 on the central bore 90 provides a seal on the air distribution tube 46. A circular opening 908 extends transversely through the rear portion of the sub 901 and the J-slots 905. An annular arcuate groove 909 is formed in the interior of each circular opening 908 spaced outwardly from each side of the slots 905 and concentric with the opening 908, and a small opening 910 extends from each groove to the outer surface of the sub 901. The openings are used to fill the grooves with ball bearings 911 after which they are enclosed by threaded plugs 912.

A piston spool 913 is slidably received on the air distribution tube 46. The piston spool 913 comprises an elongated cylindrical member having a central longitudinal bore 914 with an O-ring seal 915 near the back end to seal on the tube 46. The front portion of the spool 913 is in the form of a tube extension 916 and has a short reduced diameter 917 at the forward end. The rear portion of the spool has an enlarged diameter 918 greater than the extension 916 to define a shoulder 919 therebetween. An O-ring seal 920 is provided on the enlarged diameter 918. A pair of radially opposed threaded bores 921 and 922 extend longitudinally through the rear portion of the spool 913 to receive hose fittings for connection to an air or fluid source (not shown).

A cylindrical piston 923 having a central bore 924 is slidably mounted on the circumference of the tubular extension 916. A pair of radially opposed bores 925 and 926 in axial alignment with the bores 921 and 922 extend longitudinally through the piston 923 and are provided with internal threads 927 at the rear portion. An O-ring seal 928 disposed in the central bore 924 provides a reciprocating seal on the tubular extension 916. Another O-ring seal 929 is provided on the circumference of the piston 923.

A cylindrical bulkhead 930 having a central bore 931 is mounted on the forward end of the tubular extension 916. A pair of radially opposed bores 932 and 933 in axial alignment with the bores 925 and 926 extend longitudinally through the bulkhead 930 and are provided with internal O-ring seals 934. An O-ring seal 935 disposed in the central bore 931 provides a seal on the tubular extension 916. Another O-ring seal 936 is provided on the circumference of the bulkhead 930. A slot 937 extends vertically through one side wall of the bulkhead at the forward end and receives a rectangular key 938 for keying the bulkhead to the back end of the sub 901.

An actuating rod 939 having a flat rectangular front portion 940 and a longitudinally offset round tail portion 941 is carried by the piston 923. The front portion of the actuating rod 939 is slidably received in the elongated portion of the J-slot 905 and the tail portion 941 extends outwardly therefrom to be slidably received through the bulkhead bore 932 and provided with external threads at the rear end which are received on the threads 927 of the bore 925 in the piston 923. The rectangular front portion 940 is provided with a transverse slot 942 which engages the protruding lug of a cup-shaped member described hereinafter. An O-ring seal 948 is disposed on the circumference of the tail portion 941 to provide a seal on the piston bore 925.

Similarly, a longer, reverse actuating rod 943 having a flat rectangular front portion 944 and a longitudinally offset round tail portion 943 is carried by the piston 923. The front portion of the actuating rod 943 is slidably received in the elongated portion of the opposing J-slot 905 and the tail portion 945 extends outwardly therefrom to be slidably received through the opposed bulkhead bore 933 and provided with external threads which are received on the threads 927 of the bore 926 in the piston 923. A reduced diameter 946 extends rearwardly from the threads 927 and is slidably received within the bore 922 of the piston spool 913. The rectangular front portion 944 is provided with a transverse slot 947 which engages the protruding lug of another cup-shaped member (hereinafter described). An O-ring seal 948 is disposed on the circumference of the tail portion 945 to provide a seal on the piston bore 926.

An elongated hollow cylindrical outer sleeve 949 is slidably received on the outer periphery of the bulkhead 930, the piston 923, and the piston sleeve 913. The outer sleeve 949 has interior threads 950 at the front portion, a central longitudinal bore 951 extending therefrom and terminating at a reduced bore 952 defining an annular shoulder 953 therebetween. The outer sleeve 949 is threadedly received on the threaded portion of the sub 901 with a seal 954 provided between the front end and the sub shoulder 902. A pair of circular openings 955 extend transversely through the side wall of the sleeve in axial alignment with the opening 908 to receive the cup-shaped members (described hereinafter). The reduced bore 952 is received on a short reduced diameter 956 of the piston spool 913 and the O-rings 920, 929, and 936 providing a seal on the central bore 951.

In this manner, the above mentioned components are enclosed, and the side wall of the sleeve forms a sealed front chamber 957 between the bulkhead 930 and the piston 923. A second rear chamber 958 is formed between the piston 923 and the piston sleeve 913. A small passageway 959 extends inwardly from the back end of the reverse actuating rod 943 and communicates the bore 922 of the piston sleeve 913 with the front chamber 957. The opposed bore 921 of the piston sleeve 913 is in communication with the rear chamber 958. It should be understood that the opposed bores 921 and 922 at the back end of the piston sleeve receive hose fittings and flexible hoses extend outwardly therefrom and to be connected to the fluid or air source for effecting reciprocation of the piston.

A pair of steering fins 960 and 961 each comprising a flat rectangular fin 962 secured to a cylindrical cup-shaped member 963 and 964 are rotatably received within the transverse circular openings 908 and 955. Each cup-shaped member is provided with an annular O-ring seal 965 to provide a rotary seal on the interior of the opening 908, and a circumferential arcuate groove 966 in alignment with the grooves 909 to receive the ball bearings 911. After the bearings 911 are placed in the grooves, the tail fins are locked against outward movement, and are free to rotate about the transverse axis within the openings. The opposed cylindrical ends of the cup-shaped members 963 and 964 extend inwardly to meet at the center of the sub 901. An arcuate eliptical cut-away portion extends transversely across the ends of each cup-shaped member leaving a flat raised segment 967 and a diametrically opposed protruding lug 968 which is disposed angularly relative to the longitudinal axis of the rectangular fin 962. In this manner, when the cylindrical ends are in contact, the lugs 968 are diametrically opposed and the elliptical opening surrounds the air distribution tube 46, whether the fins are rotated to a position parallel or angularly disposed relative to the longitudinal axis of the tool. One lug is received in the slot 942 of the actuating rod and the opposing lug is received within the slot 947 of the reverse actuating rod.

Figure 37:
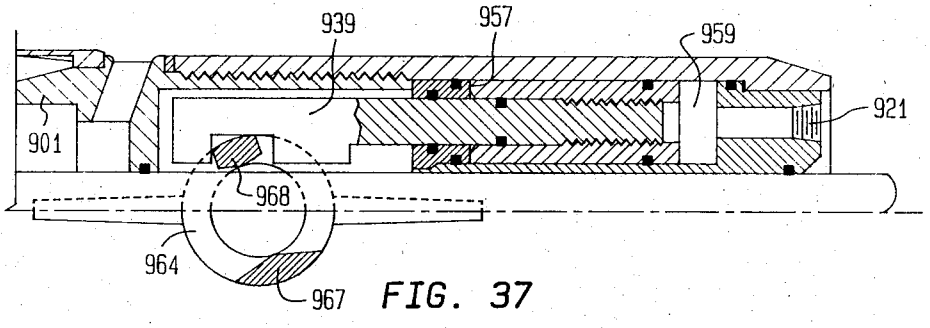
FIGS. 37 and 38 are partial longitudinal cross sections of the movable tail fin assembly of FIG. 35 showing the operation.
Figure 38:
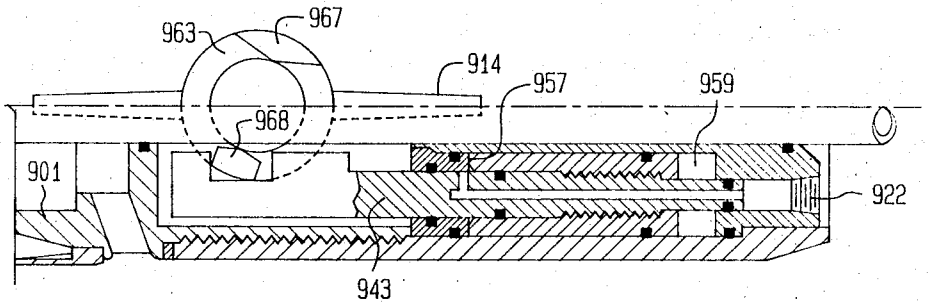

The operation of the movable tail fin assembly is best seen with reference to FIGS. 35, 37, and 38. Under action of compressed air or fluid in the front chamber 957, the piston 923 moves toward the back of the sub 901 carrying the actuating rods 939 and 943 with it. This action causes the cup-shaped members 963 and 964 to rotate in opposite directions relative to the transverse axis. When in its rearmost position, the air or fluid in the rear chamber 958 has been relieved or exhausted. In this position (FIG. 35), the fins are positioned angularly relative to the longitudinal axis of the tool body. When the two fins are inclined in opposite directions, the soil forces acting on their faces causes the tool housing to rotate about its longitudinal axis and the tool bores in a straight direction.

When the air or fluid pressure within the rear chamber 958 is relieved, the front chamber 957 is pressurized to move the pistons in the opposite direction (FIGS. 37 and 38). In this position, the fins are positioned parallel to the longitudinal axis of the tool body. In this position, the fins prevent rotation of the tool housing and the tool bores in a curved direction as a result of the asymmetric boring force of the slanted nose member or the eccentric hammer.

The positioning of the fins in parallel or anti-parallel positions may be selectively changed as necessary for proper alignment and attitude adjustment of the tool.

Figure 40:
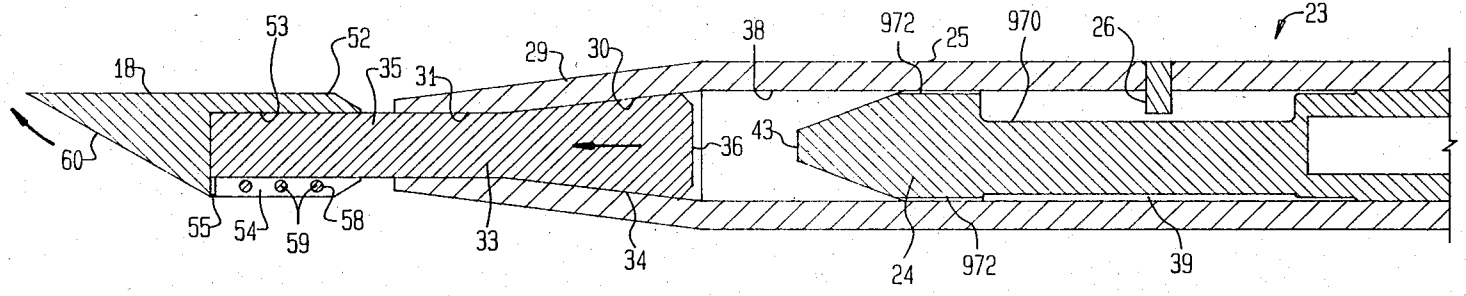
FIGS. 40 and 41 are longitudinal cross sections of a portion of a boring tool including an eccentric hammer arrangement.
Figure 41:
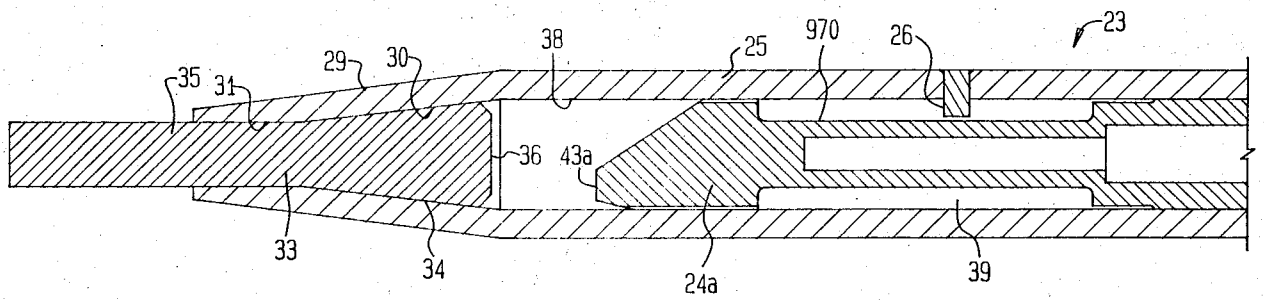

FIGS. 40 and 41 are longitudinal cross sections of a portion of a boring tool including an eccentric hammer arrangement. An off-axis or eccentric hammer may be used in combination with the tail fin arrangements described previously. When the center of mass of the hammer is allowed to strike the inner anvil at a point radially offset from the longitudinal axis of the tool, a deflective side force results. This force causes the boring tool to deviate in the direction opposite to the impact point as depicted in FIG. 40. Orientation may be controlled by the external rotation of the tool body with tail fins. The only internal modification required is the replacement of the existing hammer.

FIG. 40 shows the front portion details of a boring tool 23 which was shown previously in schematic form in FIG. 8 with a movable tail fin system in combination with an eccentric hammer 24. The rear portion of the hammer 24 is not shown, with the understanding that the rear portion of the hammer 24 would be the same as the concentric hammer 37 shown in FIG. 9B. The rear portion of the tool is not shown in FIGS. 40 or 41 since the eccentric hammer may be used in combination with either the fixed/lockable fin systems or the movable fin systems and with or without the slanted nose member previously shown and described.

Referring now to FIGS. 40, 41 and 9B, the boring tool 23 comprises an elongated hollow cylindrical outer housing or body 25. The outer front end of the body 25 tapers inwardly forming a conical portion 29. The internal diameter of the body 23 tapers inwardly near the front end forming a conical surface 30 which terminates in a reduced diameter 31 extending longitudinally inward from the front end. The rear end of the body is provided with internal threads for receiving a tail fin assembly previously described.

An anvil 33 having a conical back portion 34 and an elongated cylindrical front portion 35 is contained within the front end of the body 23. The conical back portion 34 of the anvil 33 forms and interference fit on the conical surface 30 of the body 23, and the elongated cylindrical portion 35 extends outwardly a distance beyond the front end of the body. A flat surface 36 at the back end of the anvil 33 receives the impact of the eccentric reciprocating hammer 24.

A slanted nose member 18 having a cylindrical back portion 52 and a central cylindrical bore 53 extending inwardly therefrom may be secured on the cylindrical portion 35 of the anvil 33 (FIG. 40). A slot 54 through the sidewall of the cylindrical portion 51 extends longitudinally substantially the length of the central bore 53 and a transverse slot 55 extends radially from the bore 53 to the outer circumference of the cylindrical portion, providing flexibility to the cylindrical portion for clamping the nose member to the anvil. Longitudinally spaced holes in alignment with threaded bores 58 on the opposing side of the slot 54 receive screws 59 which secure the nose member 18 to the anvil 33. The sidewall of the nose member 18 extends forward from the cylindrical portion 52 and one side is milled to form a flat inclined surface 60.

The eccentric hammer 24 is an elongated cylindrical member slidably received within the internal diameter 38 of the body 23. A substantial portion of the outer diameter of the hammer 24 is smaller in diameter than the internal diameter 38 of the body, forming an annular cavity 39 therebetween. The front portion of the hammer is constructed in a manner to offset the center of gravity of the hammer with respect to its longitudinal axis. As shown in FIG. 40, the side wall of the hammer is provided with a longitudinal slot 970 which places the center of mass eccentric to the longitudinal axis and the front surface 43 of the front end of the hammer 24 is shaped to provide an impact centrally on the flat surface 36 of the anvil 33. In FIG. 41, the side wall of the hammer **24*a* is provided with a longitudinal slot 970 and the front surface 43*a*** is radially offset from the longitudinal axis to place the center of mass eccentric to the longitudinal axis and thereby deliver an eccentric impact force on the anvil.

A series of longitudinal circumferentially spaced slots 972 are provided on the outer surface of the front of the hammer to allow passage of air or fluid from the front end to the reduced diameter portion.

In order to assure proper orientation of the hammer, a key or pin 26 is secured through the side wall of the body 25 to extend radially inward and be received within the slot 970 to maintain the larger mass of the hammer on one side of the longitudinal axis of the tool.

As shown in FIG. 9C, a relatively shorter portion 40 at the back end of the hammer 37 is of larger diameter to provide a sliding fit against the interior diameter 38 of the body. A central cavity 41 extends longitudinally inward a distance from the back end of the hammer 37. A cylindrical bushing 42 is slidably disposed within the hammer cavity 41, the circumference of which provides a sliding fit against the inner surface of the central cavity 41.

Air passages 44 are provided through the sidewall of the hammer 37 inwardly adjacent the shorter rear portion 40 to communicate the central cavity 41 with the annular cavity 39. An air distribution tube 45 extends centrally through the bushing 42 and its back end 46 extends outwardly of the body 28 and is connected by fittings 47 to a flexible hose 48. For effecting reciprocation of the hammer 37, the air distribution tube 45 is in permanent communication with a compressed air source (not shown). The arrangement of the passages 44 and the bushing 42 is such that, during reciprocation of the hammer 37, the air distribution tube 45 alternately communicates via the passages 44, the annular cavity 39 with either the central cavity 41 or atmosphere at regular intervals.

A cylindrical stop member 49 is secured within the inner diameter of the body 28 near the back end and is provided with a series of longitudinally extending, circumferentially spaced passageways 50 for communicating the interior of the body 28 with atmosphere. The air distribution tube 45 is centrally disposed within the stop member 49.

Under action of compressed air in the central cavity 41, the hammer 24 moves toward the front of the body 25. When in its foremost position, the hammer imparts an impact on the flat surface 36 of the anvil 33. In this position, compressed air is admitted through the passages 44 from the central cavity 41 into the annular cavity 39. Since the effective area of the hammer including the larger diameter rear portion 40 is greater than the effective area of the central cavity 41, the hammer starts moving in the opposite direction. During this movement, the bushing 42 closes the passages 44, thereby interrupting the admission of compressed air into annular cavity 41. The hammer 37 continues its movement due to the expansion of the air in the annular cavity 39 until the passages 44 are displayed beyond the ends of the bushing 42, and the annular cavity is placed to communication to atmosphere through the holes 50 in the stop member 49. In this position, the air is exhausted from the annular cavity 39 through the passages 44 now above the trailing edge of the bushing 42 and the holes 50 in the stop member 49. Then the cycle is repeated.

The eccentric hammer can be used for straight boring by averaging the deflective side force over 360° by rotating the outer body. The fins provide orientation capabilities as previously described and are brought into an unlocked rotating or straight parallel alignment position when executing turns. Straight boring of the tool is accomplished by activating the fins to a spin inducing position counteracting the tendency of the eccentric hammer to turn the tool.

When the fins are in a position preventing the tool housing from rotating the tool will turn under the influence of the asymmetric boring forces. Either an eccentric hammer or anvil will produce the desired result, since the only requirement is that the axis of the impact does not pass through the frontal center of pressure.

While this invention has been described fully and completely with special emphasis upon several preferred embodiments, it should be understood that within the scope of the appended claims the invention may be practiced otherwise than as specifically described herein.

We claim:

1. A controllable percussion tool for drilling holes in the soil comprising a cylindrical housing with a tapered front end, a first means on said front end for applying a boring force to the soil, a second means in said housing for applying a percussive force to said boring force applying means, said first and second means being cooperable to apply an asymmetric boring force, a rotatable sleeve member supported on the rear end of said housing, a pair of fins supported on said rotatable sleeve member in circumferentially spaced relation and having fixed angular positions thereon, said sleeve member and fins comprising a fin assembly, and means cooperable with at least one component of said fin assembly to establish one position permitting said fin assembly to rotate freely on said housing during movement through the earth and another position fixed in relation to said housing to cause said housing to rotate on movement through the earth, said boring means being operable to bore in a straight direction when said fin assembly is in said fixed position and to bore in a curved direction when said fin assembly is freely rotating.

2. A controllable percussion tool according to claim 1 in which said first means comprises an anvil having a striking surface inside said housing and a boring surface outside said housing, and said second means comprises a reciprocally movable hammer positioned in said housing to apply a percussive force to said anvil striking surface.

3. A controllable percussion tool according to claim 2 in which said anvil boring surface comprises a cylindrical nose portion having a side face extending longitudinally from the tip at an acute angle thereto.

4. A controllable percussion tool according to claim 3 in which said external anvil boring surface comprises a cylindrical body and said nose portion is removably secured thereon.

5. A controllable percussion tool according to claim 2 in which said hammer member has an asymmetric end portion for applying said asymmetric earth boring force.

6. A controllable percussion tool according to claim 2 in which said hammer member has a cylindrical body portion and an end portion asymmetric to the anvil end of said anvil member for applying a hammer blow adjacent to the periphery thereof for applying said asymmetric earth boring force.

7. A controllable percussion tool for drilling holes in the soil comprising a hollow cylindrical housing with a tapered front end, a first means on said front end for applying a boring force to the soil comprising an anvil having a striking surface inside said housing and a boring surface outside said housing comprising a cylindrical nose portion having a side face extending longitudinally from the tip at an acute angle thereto, said anvil and nose portion being secured in a fixed non-rotatable position in said housing whereby movement of said tool through the soil is deviated from a straight path by reaction of said angled side face against the soil, a second means comprising a reciprocally movable hammer positioned in said housing to apply a percussive force to said anvil striking surface for transmitting a percussive force to said boring force applying means, a plurality of guide fins positioned on the exterior of said housing at the rear end thereof and having a first position permitting non-rotative movement through the soil and a second position causing said housing to rotate about its longitudinal axis on movement through the soil, and means for moving said fins between said first and second positions, said housing having a curved path through the soil when prevented from rotation and a substantially straight path when caused to rotate.

8. A controllable percussion tool according to claim 7 in which said first means comprises an anvil having a striking surface inside said housing and a boring surface outside said housing, and said second means comprises a reciprocally movable hammer positioned in said housing to apply a percussive force to said anvil striking surface.

9. A controllable percussion tool according to claim 8 in which said anvil boring surface comprises a cylindrical nose portion having a side face extending longitudinally from the tip at an acute angle thereto.

10. A controllable percussion tool according to claim 8 in which said external anvil boring surface comprises a cylindrical body and said nose portion is removably secured thereon.

11. A controllable percussion tool according to claim 8 in which said hammer member has an asymmetric end portion for applying said asymmetric earth boring force.

12. A controllable percussion tool according to claim 8 in which said hammer member has a cylindrical body portion and an end portion asymmetric to the anvil end of said anvil member for applying a hammer blow adjacent to the periphery thereof for applying said asymmetric earth boring force.

13. A controllable percussion tool according to claim 8 in which said hammer is fluid actuated, and said housing has conduit means for connection to a source of actuating fluid.

14. A controllable percussion tool according to claim 13 in which said source of actuating fluid comprises a source of compressed air for pneumatic operation.

15. A controllable percussion tool according to claim 13 in which said source of actuating fluid comprises a source of hydraulic fluid under pressure.

16. A controllable percussion tool according to claim 7 in which a rotatable sleeve member is supported on the rear end of said housing, said fins being supported on said rotatable sleeve member in circumferentially spaced relation and having fixed angular positions thereon, said sleeve member and fins comprising a fin assembly, and means cooperable with at least one component of said fin assembly to establish one position permitting said fin assembly to rotate freely on said housing during movement through the earth and another position fixed in relation to said housing to cause said housing to rotate on movement through the earth, said boring means being operable to bore in a straight direction when said fin assembly is in said fixed position and to bore in a curved direction when said fin assembly is freely rotating.

17. A controllable percussion tool according to claim 16 in which said rear end of said housing includes a supporting sleeve portion, said rotatable sleeve member being supported on said supporting sleeve portion for rotary movement thereon, clutch means operatively interconnecting said rotatable sleeve member and said supporting sleeve portion and having a first disengaged position permitting rotation of said rotatable sleeve relative to said supporting sleeve portion and a second engaged position securing said rotatable sleeve and said supporting sleeve portion for rotation together, and means to move said clutch means to said engaged and said disengaged positions.

18. A controllable percussion tool according to claim 16 in which said rear end of said housing includes a supporting sleeve portion, said rotatable sleeve member being supported on said supporting sleeve portion for rotary movement thereon and a longitudinally fixed position, clutch means having a first part operatively secured on said rotatable sleeve member and movable therewith, a second part operatively secured on said supporting sleeve portion, and a third part movable into and out of engagement with said first and second parts, said clutch means third part having a first position disengaged from said first and second parts to permit rotation of said rotatable sleeve relative to said supporting sleeve portion and a second position engaged with said first and second parts to secure said rotatable sleeve and said supporting sleeve portion for rotation together, and means to move said third part longitudinally in relation to said first and second parts to said engaged and said disengaged positions.

19. A controllable percussion tool according to claim 18 in which said third part comprises a sleeve member slidably movable of said supporting sleeve portion and within said rotatable sleeve member and having drive surfaces operatively engagable with said rotatable sleeve member and said supporting sleeve portion to secure the same for movement together.

20. A controllable percussion tool according to claim 19 in which said slidable sleeve member is movable between a position engaged with and a position disengaged from said rotatable sleeve member and said supporting sleeve portion.

21. A controllable percussion tool according to claim 19 in which said slidable sleeve member is secured on said supporting sleeve member for rotation therewith, said rotatable sleeve member and said slidable sleeve member have at least one recess on one and one projection on the other cooperable when engaged to secure said rotatable sleeve member and said supporting sleeve member together for rotation together, and said slidable sleeve member is movable between a position engaged with and a position disengaged from said rotatable sleeve member.

22. A controllable percussion tool according to claim 16 in which said rear end of said housing includes a supporting sleeve portion, said rotatable sleeve member being supported on said supporting sleeve portion for rotary movement thereon and having a predetermined amount of longitudinal movement, clutch means having one part operatively secured on said rotatable sleeve member and movable therewith and another part operatively secured on said supporting sleeve portion, said clutch means parts having a first disengaged position permitting rotation of said rotatable sleeve relative to said supporting sleeve portion and a second engaged position securing said rotatable sleeve and said supporting sleeve portion for rotation together, and means to move said rotatable sleeve longitudinally in relation to said supporting sleeve portion to move said clutch means parts to said engaged and said disengaged positions.

23. A controllable percussion tool according to claim 22 in which said clutch means parts comprises drive teeth on said rotatable sleeve and said supporting sleeve portion respectively, and means for moving said drive teeth into and out of engagement.

24. A controllable percussion tool according to claim 23 in which said drive teeth are positioned for end to end engagement.

25. A controllable percussion tool according to claim 23 in which said drive teeth are on the inside of said rotatable sleeve and the outside of said supporting sleeve portion respectively, and means for moving at least one of said sleeves to engage and disengage said teeth.

26. A controllable percussion tool according to claim 22 in which said clutch means parts comprises drive teeth on one of said sleeves and a drive member on the other sleeve and relatively movable into and out of engagement therewith, and means for moving said drive teeth and drive member into and out of engagement.

27. A controllable percussion tool according to claim 26 in which said drive member comprises a drive pin.

28. A controllable percussion tool according to claim 22 in which said clutch means parts comprises a drive slot on one of said sleeves and a drive member on the other sleeve and relatively movable into and out of engagement therewith, and means for moving said drive slot and drive member into and out of engagement.

29. A controllable percussion tool according to claim 27 in which said drive member comprises a drive pin.

30. A controllable percussion tool according to claim 22 in which said clutch means parts comprises a drive slot on one of said sleeves and a drive spline on the other sleeve and relatively movable into and out of engagement therewith, and means for moving said drive slot and drive spline into and out of engagement.

31. A controllable percussion tool according to claim 7 in which a fixed supporting sleeve member is supported on the rear end of said housing, said fins being pivotally supported on said sleeve member in circumferentially spaced relation thereon, said fins each having a first position parallel to the longitudinal axis of said housing and a second position extending at an acute angle to the longitudinal axis of said housing, means cooperable with said fins to move the same to said first position or said second position, and said boring means being operable to bore in a straight direction when said fins are in said second position and to bore in a curved direction when said fins are in said first position.

32. A controllable percussion tool according to claim 31 in which said rear end of said housing includes a supporting sleeve portion, said fixed sleeve member being supported on said supporting sleeve portion, supporting pins for each of said fins extending into the space between said supporting sleeve portion and said fixed sleeve member and having operating means thereon, an operating member slidable on said supporting sleeve portion and engagable with said fin operating means, and means to move said operating member longitudinally in relation to said fin operating means to move the same to position said fins in said parallel or said angled position.

33. A controllable percussion tool according to claim 32 in which said pin operating means comprises a rotary member secured on each of said supporting pins, said operating member comprises a slidably movable sleeve, said pin-operating rotary member and said drive sleeve having a recess in one and a projecting drive member on the other cooperable for rotating each of said fin members upon sliding movement of said slidably movable sleeve.

34. A controllable percussion tool for drilling holes in the soil comprising a hollow cylindrical housing with a tapered front end, a first means on said front end for applying a boring force to the soil comprising an anvil having a striking surface inside said housing and a boring surface outside said housing comprising a cylindrical nose portion having a side face extending longitudinally from the tip at an acute angle thereto, said anvil and nose portion being secured in a fixed non-rotatable position in said housing whereby movement of said tool through the soil is deviated from a straight path by reaction of said angled side face against the soil, a second means comprising a reciprocally movable hammer positioned in said housing to apply a percussive force to said anvil striking surface for transmitting a percussive force to said boring force applying means, means for connecting said hammer to an external energy supplying means, a plurality of guide fins positioned on the exterior of said housing at the rear end thereof and having a first position permitting non-rotative movement through the soil and a second position with the fins fixed relative to said housing at an angle causing said housing to rotate about its longitudinal axis on movement through the soil, and externally operated means for moving said fins between said first and second positions, whereby said tool has a curved path through the soil when said housing is prevented from rotation and a substantially straight path when caused to rotate.

35. A controllable percussion tool according to claim 34 in which said hammer is fluid actuated, and said connecting means comprises conduit means for connection to a source of actuating fluid.

36. A controllable percussion tool according to claim 35 in which said source of actuating fluid comprises a source of compressed air for pneumatic operation.

37. A controllable percussion tool according to claim 35 in which said source of actuating fluid comprises a source of hydraulic fluid under pressure.

38. A controllable percussion tool according to claim 34 in which said anvil member and said hammer member comprise earth boring means, and at least one member of said earth boring means including means for producing an asymmetric earth boring force.

39. A controllable percussion tool according to claim 38 in which said percussion operated tip comprises a cylindrical nose portion having a side face extending longitudinally from the tip at an acute angle thereto.

40. A controllable percussion tool according to claim 39 in which said percussion operated tip comprises a cylindrical body and said nose portion is removably secured thereon.

41. A controllable percussion tool according to claim 38 in which said hammer member has an asymmetric end portion for applying said asymmetric earth boring force.

42. A controllable percussion tool according to claim 38 in which said hammer member has a cylindrical body portion and an end portion asymmetric to the anvil end of said anvil member for applying a hammer blow adjacent to the periphery thereof for applying said asymmetric earth boring force.

43. A controllable percussion tool according to claim 38 in which a rotatable sleeve member is supported on the rear end of said housing, said fins being supported on said rotatable sleeve member in circumferentially spaced relation and having fixed angular positions thereon, said sleeve member and fins comprising a fin assembly, and means cooperable with at least one component of said fin assembly to establish one position permitting said fin assembly to rotate freely on said housing during movement through the earth and another position fixed in relation to said housing to cause said housing to rotate on movement through the earth, said boring means being operable to bore in a straight direction when said fin assembly is in said fixed position and to bore in a curved direction when said fin assembly is freely rotating.

44. A controllable percussion tool according to claim 43 in which said rear end of said housing includes a supporting sleeve portion, said rotatable sleeve member being supported on said supporting sleeve portion for rotary movement thereon, clutch means operatively interconnecting said rotatable sleeve member and said supporting sleeve portion and having a first disengaged position permitting rotation of said rotatable sleeve relative to said supporting sleeve portion and a second engaged position securing said rotatable sleeve and said supporting sleeve portion for rotation together, and means to move said clutch means to said engaged and said disengaged positions.

45. A controllable percussion tool according to claim 43 in which said rear end of said housing includes a supporting sleeve portion, said rotatable sleeve member being supported on said supporting sleeve portion for rotary movement thereon and a longitudinally fixed position, clutch means having a first part operatively secured on said rotatable sleeve member and movable therewith, a second part operatively secured on said supporting sleeve portion, and a third part movable into and out of engagement with said first and second parts, said clutch means third part having a first position disengaged from said first and second parts to permit rotation of said rotatable sleeve relative to said supporting sleeve portion and a second position engaged with said first and second parts to secure said rotatable sleeve and said supporting sleeve portion for rotation together, and means to move said third part longitudinally in relation to said first and second parts to said engaged and said disengaged positions.

46. A controllable percussion tool according to claim 43 in which said rear end of said housing includes a supporting sleeve portion, said rotatable sleeve member being supported on said supporting sleeve portion for rotary movement thereon and having a predetermined amount of longitudinal movement, clutch means having one part operatively secured on said rotatable sleeve member and movable therewith and another part operatively secured on said supporting sleeve portion, said clutch means parts having a first disengaged position permitting rotation of said rotatable sleeve relative to said supporting sleeve portion and a second engaged position securing said rotatable sleeve and said supporting sleeve portion for rotation together, and means to move said rotatable sleeve longitudinally in relation to said supporting sleeve portion to move said clutch means parts to said engaged and said disengaged positions.

47. A controllable percussion tool according to claim 38 in which a fixed supporting sleeve member is supported on the rear end of said housing, said fins being pivotally supported on said sleeve member in circumferentially spaced relation thereon, said fins each having a first position parallel to the longitudinal axis of said housing and a second position extending at an acute angle to the longitudinal axis of said housing, means cooperable with said fins to move the same to said first position or said second position, and said boring means being operable to bore in a straight direction when said fins are in said second position and to bore in a curved direction when said fins are in said first position.

48. A controllable percussion tool according to claim 47 in which said rear end of said housing includes a supporting sleeve portion, said fixed sleeve member being supported on said supporting sleeve portion, supporting pins for each of said fins extending into the space between said supporting sleeve portion and said fixed sleeve member and having operating means thereon, an operating member slidable on said supporting sleeve portion and engagable with said fin operating means, and means to move said operating member longitudinally in relation to said fin operating means to move the same to position said fins in said parallel or said angled position.

49. A controllable percussion tool according to claim 48 in which said pin operating means comprises a rotary member secured on each of said supporting pins and having a drive recess therein, and said operating member comprises a slidably movable sleeve having a drive member cooperable with said drive recess for rotating each of said fin members upon sliding movement of said slidably movable sleeve.

50. A controllable percussion tool for drilling holes in the soil comprising a cylindrical housing with a tapered front end, a first means on said front end for applying a boring force to the soil comprising an anvil having a striking surface inside said housing and a boring surface outside said housing comprising a cylindrical nose portion having a side face extending longitudinally from the tip at an acute angle thereto, said anvil and nose portion being secured in a fixed non-rotatable position in said housing whereby movement of said tool through the soil is deviated from a straight path by reaction of said angled side face against the soil, a second means comprising a reciprocally movable hammer positioned in said housing to apply a percussive force to said anvil striking surface for transmitting a percussive force to said boring force applying means, at least one guide fin positioned on the exterior of said housing at the rear end thereof having one position preventing rotary motion of said housing about its longitudinal axis and another position permitting rotary motion of said housing about its longitudinal axis, said housing having a curved path through the soil when prevented from rotation and a substantially straight path when permitted to rotate.

51. A controllable percussion tool for drilling holes in the soil comprising a hollow cylindrical housing with a tapered front end, a first means on said front end for applying a boring force to the soil, a second means in said housing for applying a percussive force to said boring force applying means, said first and second means being cooperable to apply an asymmetric boring force, a rotatable sleeve member supported on the rear end of said housing, a pair of fins supported on said rotatable sleeve member in circumferentially spaced relation and having fixed angular positions thereon, said sleeve member and fins comprising a fin assembly, and means cooperable with at least one component of said fin assembly to establish one position permitting said fin assembly to rotate freely on said housing during movement through the earth and another position fixed in relation to said housing to cause said housing to rotate on movement through the earth, said boring means being operable to bore in a straight direction when said fin assembly is in said fixed position and to bore in a curved direction when said fin assembly is freely rotating.

* * * * *